US010235880B2

(12) United States Patent
Seo

(10) Patent No.: US 10,235,880 B2
(45) Date of Patent: Mar. 19, 2019

(54) METHOD AND APPARATUS FOR FORECASTING FLOW OF TRAFFIC

(71) Applicant: Samsung Electronics Co., Ltd., Gyeonggi-do (KR)

(72) Inventor: Youngjun Seo, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 13 days.

(21) Appl. No.: 15/107,295

(22) PCT Filed: Feb. 16, 2015

(86) PCT No.: PCT/KR2015/001514
§ 371 (c)(1),
(2) Date: Jun. 22, 2016

(87) PCT Pub. No.: WO2015/122729
PCT Pub. Date: Aug. 20, 2015

(65) Prior Publication Data

US 2016/0321923 A1 Nov. 3, 2016

(30) Foreign Application Priority Data

Feb. 17, 2014 (KR) ..... 10-2014-0017751

(51) Int. Cl.
*G08G 1/0967* (2006.01)
*G08G 1/01* (2006.01)
*G08G 1/16* (2006.01)

(52) U.S. Cl.
CPC ..... *G08G 1/096741* (2013.01); *G08G 1/0112* (2013.01); *G08G 1/0129* (2013.01); *G08G 1/0133* (2013.01); *G08G 1/0141* (2013.01); *G08G 1/096716* (2013.01); *G08G 1/096758* (2013.01); *G08G 1/096775* (2013.01);
(Continued)

(58) Field of Classification Search
None
See application file for complete search history.

(56) References Cited

U.S. PATENT DOCUMENTS 4,531,298 A * 7/1985 West, Jr. ..... G01C 17/38 33/301
6,199,015 B1 * 3/2001 Curtwright ..... G01C 21/20 340/990

(Continued)

FOREIGN PATENT DOCUMENTS

CN 101431767 A 5/2009
CN 101815310 A 8/2010

(Continued)

OTHER PUBLICATIONS

PCT International Search Report dated May 21, 2015.
European Search Report dated Mar. 23, 2018.
Chinese Search Report dated Jun. 4, 2018.

*Primary Examiner* — Chico A Foxx
(74) *Attorney, Agent, or Firm* — Cha & Reiter, LLC.

(57) ABSTRACT

Disclosed are a method and an apparatus for forecasting the flow of traffic. The method includes: detecting measurement information of a vehicle by using a sensor; generating vector data based on the measurement information; and transmitting the generated vector data.

25 Claims, 32 Drawing Sheets

(52) U.S. Cl.
CPC ..... *G08G 1/096791* (2013.01); *G08G 1/162* (2013.01); *G08G 1/163* (2013.01); *G08G 1/164* (2013.01)

(56) References Cited

U.S. PATENT DOCUMENTS 6,430,506 B1 * 8/2002 Mon ..... B60T 7/22 701/301
6,590,507 B2 * 7/2003 Burns ..... G08G 1/096827 340/905
7,268,700 B1 * 9/2007 Hoffberg ..... G08G 1/0104 340/539.17
7,359,821 B1 * 4/2008 Smith ..... G07C 5/002 702/113
7,899,621 B2 * 3/2011 Breed ..... B60N 2/2863 340/995.1
8,855,915 B2 * 10/2014 Furuhata ..... G01C 21/3629 701/408
9,153,131 B2 * 10/2015 Santucci ..... G08G 1/0104
9,457,754 B1 * 10/2016 Christensen ..... B60R 21/0136
9,466,214 B2 * 10/2016 Fuehrer ..... G08G 1/205
2004/0193374 A1 * 9/2004 Hac ..... B60K 31/0008 701/301
2004/0267455 A1 * 12/2004 Hatano ..... G01C 21/3461 702/2
2005/0209766 A1 * 9/2005 Perisho, Jr. ..... B60K 31/0083 701/96
2005/0273258 A1 12/2005 MacNeille et al.
2005/0278113 A1 * 12/2005 Maruyama ..... G08G 1/096783 701/436
2007/0080825 A1 * 4/2007 Shiller ..... B60R 21/013 340/903
2007/0132564 A1 * 6/2007 Dickmann ..... G07C 5/008 340/436
2007/0167147 A1 * 7/2007 Krasner ..... G08B 25/009 455/404.2
2008/0091352 A1 4/2008 O'Hare
2010/0049393 A1 * 2/2010 Emam ..... G06N 5/02 701/31.4
2010/0114465 A1 * 5/2010 Kim ..... G08G 1/092 701/117
2010/0190449 A1 7/2010 Suzuki
2011/0313654 A1 12/2011 Olson et al.
2012/0143587 A1 * 6/2012 Minemura ..... G08G 1/16 703/21
2012/0146809 A1 * 6/2012 Oh ..... G07C 5/085 340/901
2012/0249341 A1 * 10/2012 Brown ..... G08G 1/0104 340/902
2012/0323474 A1 * 12/2012 Breed ..... B60W 30/04 701/117
2013/0116919 A1 * 5/2013 Furuhata ..... G01C 21/3629 701/408
2013/0144551 A1 6/2013 Zhou et al.
2013/0231824 A1 * 9/2013 Wilson ..... G05D 1/0246 701/26
2013/0279393 A1 * 10/2013 Rubin ..... H04J 3/1694 370/312
2013/0321179 A1 12/2013 Santucci et al.
2014/0005908 A1 * 1/2014 Kollberg ..... B60W 10/06 701/96
2014/0019005 A1 1/2014 Lee et al.
2014/0172496 A1 * 6/2014 Rosjat ..... G06Q 10/0635 705/7.28
2014/0298311 A1 * 10/2014 Abe ..... G06F 8/65 717/171
2015/0119081 A1 * 4/2015 Ayoob ..... G01S 13/87 455/456.3
2015/0253142 A1 * 9/2015 Kornhauser ..... G01C 21/3415 701/522
2015/0253772 A1 * 9/2015 Solyom ..... G05D 1/0212 701/25
2015/0321632 A1 * 11/2015 Shin ..... B60R 21/0134 280/735
2017/0219356 A1 * 8/2017 Murayama ..... G01C 21/26

FOREIGN PATENT DOCUMENTS

CN 103039106 A 4/2013
JP 2000-57476 A 2/2000
JP 2009-217371 A 9/2009
JP 2010-187136 A 8/2010
KR 10-2012-0003149 A 1/2012
KR 10-2012-0019665 A 3/2012
KR 10-2013-0140331 A 12/2013
KR 101368589 B1 * 2/2014 ..... G08G 1/0965

* cited by examiner

FIG. 6B

| | Measurement information | Change amount | Note |
|---|---|---|---|
| Entrance | Vector data | No change | Constant velocity |
| | Acceleration information | No change | Constant velocity |
| | Angular velocity information | No change | No direction change |
| Icy road | Vector data | No change ( $V_2 < V_1$ ) | Small change due to slide in movement direction |
| | Acceleration information | No change | Small change in acceleration due to rotation |
| | Angular velocity information | Change in angular velocity | Generation of angular velocity due to vehicle rotation |
| Way out | Vector data | Reduction in vector size ( $V_3 < V_2 < V_1$ ) | Increase in friction with road due to vehicle rotation |
| | Acceleration information | No change | Small change in acceleration due to rotation |
| | Angular velocity information | Change in angular velocity | From changed direction to direction for normal driving |

FIG. 7B

| | Measurement information | Change amount | Note |
|---|---|---|---|
| Entrance | Vector data | Reduction in size ( $V_2 < V_1$ ) | Brake due to obstacles |
| | Acceleration information | Reduction in movement direction acceleration | Sudden deceleration |
| | Angular velocity information | No change | No direction change |
| Obstacles | Vector data | Change in vector direction ( $V_2$ , $V_3$) | Detour due to rockslide, drive at low speed |
| | Acceleration information | No change | Small change in acceleration due to rotation |
| | Angular velocity information | Change in angular velocity ( $W_1$, $W_2$) | Detour due to rockslide |
| Way out | Vector data | Increase in vector size ( $V_4 > V_3$) | Escape rockslide section |
| | Acceleration information | Increase in movement direction acceleration | (small) change in acceleration due to acceleration |
| | Angular velocity information | No change | No direction change |

FIG. 8B

| | Measurement information | Change amount | Note |
|---|---|---|---|
| Note | Vector data | No change | Constant velocity |
| | Acceleration information | No change | Constant velocity |
| | Angular velocity information | No change | No direction change |
| Road damage | Vector data | Reduction in vector size ( $V_2 < V_1$ ) | Constant velocity |
| | Acceleration information | Impact in ground direction | Impact to accelerometer in ground direction (Z axis) |
| | Angular velocity information | Change in angular velocity ( $W_1$ ) | Small change to avoid road damage |
| Way out | Vector data | Increase in vector size ( $V_3 > V_2$ ) | Increase in speed |
| | Acceleration information | No change | Constant velocity |
| | Angular velocity information | No change | No direction change |

FIG. 9B

| | Measurement information | Change amount | Note |
|---|---|---|---|
| Entrance | Vector data | Reduction in size ( $V_2 < V_1$ ) | Difficulty in securing clear view/ brake due to deterioration of road state |
| | Acceleration information | Reduction in movement direction acceleration | Sudden deceleration |
| | Angular velocity information | No change | No direction change |
| Low speed section | Vector data | No change | Constant velocity |
| | Acceleration information | No change | Constant velocity |
| | Angular velocity information | No change | No direction change |
| Way out | Vector data | Increase in vector size ( $V_3 > V_2$ ) | Escape low speed section |
| | Acceleration information | Increase in movement direction acceleration | Small) change in acceleration due to acceleration |
| | Angular velocity information | No change | No direction change |

FIG. 10B

| | Measurement information | Change amount | Note |
|---|---|---|---|
| Entrance | Vector data | Reduction in size ( $V_2 < V_1$ ) | Collision in front |
| | Acceleration information | Reduction in movement direction acceleration | Sudden deceleration |
| | Angular velocity information | No change | No direction change |
| Collision | Vector data | Change in vector direction | Avoid collision area, drive at low speed |
| | Acceleration information | No change | Small change in acceleration due to rotation |
| | Angular velocity information | Change in angular velocity ( $W_1$ ) | Detour due to collision |
| Way out | Vector data | Increase in vector size ( $V_4 > V_3$ ) | Escape collision section |
| | Acceleration information | Increase in movement direction acceleration | (Small) change in acceleration due to acceleration |
| | Angular velocity information | No change | No direction change |

FIG. 11B

| | Measurement information | Change amount | Note |
|---|---|---|---|
| Collision | Vector data | Rapid reduction in vector size ($V_0$) | Stop due to collision |
| | Acceleration information | Impact to movement direction acceleration | Collision impact |
| | Angular velocity information | No change | No direction change |

FIG. 12B

| | Measurement information | Change amount | Note |
|---|---|---|---|
| Entrance | Vector data | Reduction in size ( $V_2 < V_1$ ) | Congestion due to merging of vehicles |
| | Acceleration information | Reduction in movement Direction acceleration | Sudden deceleration |
| | Angular velocity information | No change | No direction change |
| Merging section | Vector data | Reduction in size ( $V_2$ ) | Avoid collision area, drive at low speed |
| | Acceleration information | No change | Small change in acceleration due to rotation (low speed) |
| | Angular velocity information | Change in angular velocity | Rotation of vehicle for merging of lanes (small change) |
| Way out | Vector data | Increase in vector size ( $V_3 > V_2$ ) | Escape merging section |
| | Acceleration information | Increase in movement direction acceleration | (Small) change in acceleration to acceleration |
| | Angular velocity information | No change | No direction change |

FIG. 13B

| | Measurement information | Change amount | Note |
|---|---|---|---|
| Entrance | Vector data | Reduction in size ( $V_2 < V_1$ ) | Congestion in crossroad |
| | Acceleration information | Reduction in movement direction acceleration | Sudden deceleration |
| | Angular velocity information | No change | No direction change |
| Crossroad | Vector data | Reduction in size ( $V_2$ ) | Drive at low speed |
| | Acceleration information | No change | Small change in acceleration due to rotation |
| | Angular velocity information | Change in angular velocity ($W_1$) | Rotation for movement to crossroad (small change) |
| Way out | Vector data | Increase in vector size ( $V_3$ ) | Escape crossroad section |
| | Acceleration information | Increase in movement direction acceleration | (Small) change in acceleration due to acceleration |
| | Angular velocity information | No change | No direction change |

FIG. 14B

| | Measurement information | Change amount | Note |
|---|---|---|---|
| Entrance | Vector data | Reduction in size ( $V_2 < V_1$ ) | Reduction in speed due to congestion |
| | Acceleration information | Acceleration in movement direction | Sudden deceleration |
| | Angular velocity information | No change | No direction change |
| Congestion section | Vector data | No change ( $V_2$ ) | Constant velocity |
| | Acceleration information | No change | Constant velocity |
| | Angular velocity information | No change | No direction change |

FIG. 15

| | Measurement information | Icy road | Obstacles | Road damage | low speed section | Collision (detour) | Merging section | Crossroad | Congestion |
|---|---|---|---|---|---|---|---|---|---|
| | | Change amount | Change amount | Change amount | Change amount | Change amount | Change amount | Change amount | Change amount |
| Entrance | Cector data | × | ○ (reduction) | × | ○ (reduction) | ○ (reduction) | ○ (reduction) | ○ (reduction) | ○ (reduction) |
| | Acceleration information | × | ○ | × | ○ (reduction) | ○ (reduction) | ○ (reduction) | ○ (reduction) | ○ (reduction) |
| | Angular velocity information | × | × | × | × | × | × | × | × |
| Accident | Cector data | × | △ (direction) | △ (reduction) | × | ○ (direction) | ○ (reduction) | ○ (reduction) | × |
| | Acceleration information | × | × | △ (Shock) | × | × | × | × | × |
| | Angular velocity information | ○ | △ | × | × | ○ | △ | △ | × |
| Way out | Cector data | △ (reduction) | ○ | × | ○ (increase) | ○ (increase) | ○ (increase) | ○ (increase) | – |
| | Acceleration information | × | ○ | × | ○ (increase) | ○ (increase) | △ (increase) | △ (increase) | – |
| | Angular velocity information | ○ | × | × | × | × | × | × | – |

FIG. 17

| Location information | Road information | Road history information | Road condition information | Weather information | Time information |
|---|---|---|---|---|---|
| (35.1, 127.3) | Curved road, 80km/h | Area where accidents occur frequently | - | Clear | 09:20 am |
| (37.2, 129.5) | Dcurved road, 50km/h + | Icy | - | Below -2 degrees, snow | 17:50 pm |
| (38.3, 131.5) | Straight road, 50km/h | Slide in rain | Collision | 0 degrees, 10 mm of precipitation | 13:10 pm |
| (36.2, 129.1) | Curved road, 30km/h | Landslide | Congestion | Below -5 degrees | 11:10 am |
| (35.7, 126.8) | Curved road, 100km/h | - | - | Clear | 11:20 am |

FIG. 19B

| | Measurement information | Change amount | Note |
|---|---|---|---|
| Overspeeding | Vector data | Increase/reduction in vector size | Overspeeding vehicle |
| | Acceleration information | Increase in acceleration | Large change in acceleration due to acceleration |
| | Angular velocity information | Change in angular velocity | Large change in angular velocity due to high speeds |
| Drunk driving | Vector data | Vector size direction change | Other vehicles and other vector tendency |
| | Acceleration information | Change in acceleration | Sudden vehicle directional control |
| | Angular velocity information | Change in angular velocity | Sudden vehicle directional control |

METHOD AND APPARATUS FOR FORECASTING FLOW OF TRAFFIC

CLAIM OF PRIORITY

This application is a National Phase Entry of PCT International Application No. PCT/KR2015/001514, which was filed on Feb. 16, 2015, and claims a priority to an earlier Korean Patent Application No. 10-2014-0017751, which was filed on Feb. 17, 2014, the contents of which are incorporated herein by reference.

TECHNICAL FIELD

The present disclosure relates generally to a method and an apparatus for forecasting the flow of traffic based on measurement data within a vehicle.

BACKGROUND ART

According to the development of electronic and communication technologies, various types of electronic devices have been developed. Among such electronic devices, portable devices that consider user's convenience, for example, mobile phones, smart phones, tablet Personal Computers (PC), video phones, e-book readers, Personal Digital Assistants (PDA), Portable Multimedia Players (PDA), and MP3 players are widely and frequently used.

Meanwhile, a navigation terminal corresponds to an electronic device that is manufactured to be installed in a vehicle so as to provide a main function of providing a driver with directions. The navigation terminal helps the driver easily reach a destination by providing a map required for driving in the correct direction and displaying the map on a screen through an interface. When the navigation terminal provides a route to a destination, the navigation terminal reflects the flow of traffic detected through cameras or sensors installed on roads at predetermined intervals. Alternatively, when a user who is travelling on a road where a particular event such as an accident has occurred transmits road condition information to a server, the navigation terminal receives the flow of traffic on the road to use it when providing a route.

DISCLOSURE OF INVENTION

Technical Problem

According to the prior art, a camera or sensor should be installed on a road to detect the flow of traffic or a user cannot help depending on information transmitted from other users. Accordingly, in a road section where a sensor value cannot be received or when an accident happens within a short time, it is difficult to rapidly deal with such a sudden change in traffic conditions.

Solution to Problem

An aspect of the present disclosure is to provide a method and an apparatus for forecasting the flow of traffic, which can forecast a dangerous situation for a vehicle in real time through measurement information detected by a sensor or electronic device installed in the vehicle.

In accordance with an aspect of the present disclosure, a measurement method using an electronic device installed in a vehicle is provided. The measurement method includes: detecting measurement information of the vehicle by using a sensor; generating vector data based on the measurement information; and transmitting the generated vector data.

In accordance with another aspect of the present disclosure, a method of measuring the flow of traffic using an electronic device is provided. The method includes: collecting vector data from a portable device within a vehicle; determining an accident type based on the vector data; and filtering the accident type to forecast the flow of traffic.

In accordance with another aspect of the present disclosure, an electronic device is provided. The electronic device includes: a sensor for detecting measurement information of a vehicle; a controller for generating vector data based on the measurement information; and a communication unit for transmitting the generated vector data.

In accordance with another aspect of the present disclosure, an electronic device is provided. The electronic device includes: a communication unit for collecting vector data from a portable device within a vehicle; and a controller for determining an accident type based on the vector data and filtering the accident type to forecast the flow of traffic.

Advantageous Effects of Invention

According to various embodiments of the present disclosure, it is possible to forecast a dangerous situation of a vehicle in real time through measurement information detected by a sensor or electronic device installed in the vehicle.

According to various embodiments of the present disclosure, more accurate vector data can be acquired by correcting vector data through a geomagnetic sensor, and accordingly, a dangerous situation can be easily detected based on the vector data containing location information of the vehicle.

According to various embodiments of the present disclosure, an accident can be more accurately predicted by determining an accident type through road information, road history information, weather information, time information, and road condition information as well as vector data.

BRIEF DESCRIPTION OF DRAWINGS

The above and other objects, features and advantages of the present disclosure will be more apparent from the following detailed description in conjunction with the accompanying drawings, in which:

FIGS. 6A and 6B illustrate an example of determining whether an accident type corresponds to an icy road according to various embodiments of the present disclosure;

FIGS. 7A and 7B illustrate an example of determining whether an accident type corresponds to obstacles according to various embodiments of the present disclosure;

FIGS. 8A and 8B illustrate an example of determining whether an accident type corresponds to road damage according to various embodiments of the present disclosure;

FIGS. 9A and 9B illustrate an example of determining whether an accident type corresponds to a low speed section according to various embodiments of the present disclosure;

FIGS. 10A and 10B illustrate an example of determining whether an accident type corresponds to a collision according to various embodiments of the present disclosure;

FIGS. 11A and 11B illustrate another example of determining whether an accident type corresponds to a collision according to various embodiments of the present disclosure;

FIGS. 12A and 12B illustrate an example of determining whether an accident type corresponds to a merging section according to various embodiments of the present disclosure;

FIGS. 13A and 13B illustrate an example of determining whether an accident type corresponds to a crossroad according to various embodiments of the present disclosure;

FIGS. 14A and 14B illustrate an example of determining whether an accident type corresponds to a congestion section according to various embodiments of the present disclosure;

FIG. 15 illustrates an example of an accident type table according to various embodiments of the present disclosure;

FIG. 17 is a filtering table according to various embodiments of the present disclosure;

FIGS. 19A and 19B illustrate an example of detecting danger elements according to various embodiments of the present disclosure;

MODE FOR THE INVENTION

Figure 1:
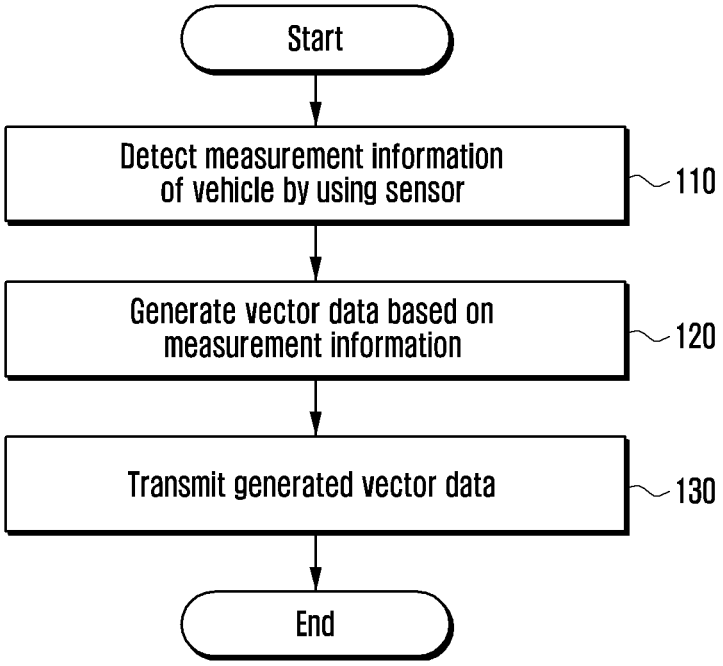
FIG. 1 is a flowchart illustrating a measurement method according to various embodiments of the present disclosure.

Hereinafter, various embodiments will be described in detail with reference to the accompanying drawings. It should be noted that the same elements will be designated by the same reference numerals although they are shown in different drawings. Further, a detailed description of a known function and configuration which may make the subject matter of the present disclosure unclear will be omitted. Hereinafter, it should be noted that only the descriptions will be provided that may help understanding the operations provided in association with the various embodiments of the present disclosure, and other descriptions will be omitted to avoid making the subject matter of the present disclosure rather unclear.

An electronic device according to the present disclosure may be a device including a communication function. For example, the electronic device may include at least one of a smart phone, a tablet Personal Computer (PC), a mobile phone, a video telephone, an e-book reader, a desktop PC, a laptop PC, a netbook computer, a Personal Digital Assistant (PDA), a Portable Multimedia Player (PMP), an MP3 player, a mobile medical appliance, a camera, a game machine, and a wearable device (e.g., a Head-Mounted-Devie (HMD) such as electronic glasses, electronic clothing, an electronic bracelet, an electronic necklace, an electronic appcessory, an electronic tattoo, and a smart watch).

According to an embodiment, an electronic device may be a smart home appliance with a communication function. The smart home appliances may include at least one of, for example, televisions, digital video disk (DVD) players, audio players, refrigerators, air conditioners, cleaners, ovens, microwaves, washing machines, air purifiers, set-top boxes, TV boxes (e.g., HomeSync™ of Samsung, Apple TV™, or Google TV™), game consoles, electronic dictionaries, electronic keys, camcorders, or electronic frames.

According to some embodiments, the electronic device may include at least one of various types of medical devices (for example, Magnetic Resonance Angiography (MRA), Magnetic Resonance Imaging (MRI), Computed Tomography (CT), a scanning machine, ultrasonic wave device and the like), a navigation device, a Global Positioning System (GPS) receiver, an Event Data Recorder (EDR), a Flight Data Recorder (FDR), a car infotainment device, ship electronic equipment (for example, navigation equipment for a ship, a gyro compass and the like), avionics, a security device, and an industrial or home robot.

According to some embodiments, the electronic device may include at least one of furniture or a part of a building/structure, an electronic board, an electronic signature receiving device, a projector, and various types of measuring devices (for example, a water meter, an electric meter, a gas meter, a radio wave meter and the like) including a camera function. The electronic device according to the present disclosure may be a combination of one or more of the aforementioned various devices. Further, it is obvious to those skilled in the art that the electronic device according to the present disclosure is not limited to the aforementioned devices.

FIG. 1 is a flowchart illustrating a measurement method according to various embodiments of the present disclosure. The measurement method according to the present disclosure may be performed by an electronic device installed in a vehicle.

Referring to FIG. 1, in operation 110, the electronic device may detect measurement information of the vehicle by using a sensor. For the detection, the electronic device may include at least one of a gyro sensor, a Global Positioning System (GPS) sensor, an acceleration sensor, and an earth magnetic field sensor. The gyro sensor may detect angular velocity information of the vehicle. The GPS sensor may detect location information of the vehicle. The acceleration sensor may detect acceleration information of the vehicle. The electronic device may further include an earth magnetic field sensor. The earth magnetic field sensor may detect a movement direction (bearing information) of the vehicle. The movement direction of the vehicle may be location information or bearing information.

The electronic device may generate vector data based on the measurement information in operation 120. The vector data means data generated based on the measurement information. For example, the vector data may include at least one of displacement, velocity, acceleration, and position of the vehicle as well as a location of the vehicle. Hereinafter, although data generated based on the measurement information will be described as vector data, the data may include vector, displacement, velocity, acceleration, and position (bearing). Accordingly, the vector data is not limited to the vector but may include "displacement", "velocity", "acceleration", "position" or other information as well as vector.

For example, the electronic device may generate the vector data by using at least one of the angular velocity information, bearing information, location information, and acceleration information. Alternatively, the electronic device may generate, as vector data, a change amount of the location information according to time and further reflect the bearing information, angular velocity information, and velocity information in the generated vector data, so as to correct the vector data.

According to various embodiments, the electronic device may correct the vector data using the earth magnetic field sensor. Since the earth magnetic field sensor may acquire bearing information according to the direction of east, west, south, and north using the earth's magnetic field, the electronic device may use bearing information of the earth magnetic field sensor in order to correct an error of the gyro sensor which is divergent with respect to time. Accordingly, the electronic device may acquire more accurate vector data by reflecting the bearing information in the vector data. That is, as described above, the vector data is not limited to the "vector" but may mean "displacement", "velocity", "acceleration", "position" or other information as well as the vector.

According to various embodiments, the electronic device may receive sensor information from a sensor installed within the vehicle or receive sensor information from a sensor installed within another vehicle adjacent to the vehicle. Another vehicle may be a vehicle located in front of, behind, or next to the vehicle, or a vehicle located within a predetermined range (for example, within a radius 10 m) from the vehicle. The sensor information may include information on velocity, orientation, or distance between vehicles. Accordingly, the electronic device may use the sensor information as measurement information of the vehicle to generate the vector data. Alternatively, the electronic device may correct the vector data using the sensor information. The electronic device may acquire more accurate vector data using the sensor information for correcting an error value of the sensor included in the electronic device.

In operation 130, the electronic device transmits the generated vector data to an external device. The external device may be a vehicle forecast server or an electronic device within another vehicle. For example, the electronic device may transmit the vector data to the vehicle forecast server. The vehicle forecast server serves to provide a vehicle forecast service for informing the electronic device of a dangerous situation by collecting the vector data and determining an accident type based on the vector data. The vehicle forecast server may inform only electronic devices that have joined the vehicle forecast service of the dangerous situation, may inform all vehicles within a predetermined range from a location where the dangerous situation occurs, or may inform electronic devices within vehicles that have agreed to receive information on the dangerous situation. Alternatively, the electronic device may transmit the vector data to electronic devices within other vehicles adjacent to the vehicle. The electronic devices within other vehicles may receive the vector data and reflect sensor information detected by themselves in the received vector data, so as to determine dangerous situations.

The electronic device according to various embodiments may detect dangerous situation information based on the sensor information and informs of the detected dangerous situation information. The dangerous situation information may include at least one accident type of icy road, obstacles (for example, rockslide or landslide), road damage, low speed section, collision, merging section, crossroad, and congested section. The electronic device may compare the dangerous situation information with a preset degree of danger, and may differently inform of the dangerous situation information according to the corresponding degree of danger based on a result of the comparison. The degree of danger may be differently set according to the accident type or a forecast rate of the dangerous situation information. For example, when the accident type corresponds to the icy road, obstacles, or collision, the electronic device may set the degree of danger to be higher than that of the merging section, crossroad, or congested section. Alternatively, the electronic device may set the degree of danger to be higher according to the order of the icy road, obstacles, road damage, low speed section, collision, merging section, crossroad, and congested section. Alternatively, the degree of danger may be gradually higher according to the order of forecast rates 30%, 50%, and 70% or higher. For example, the electronic device may increase the degree of danger according to the order of below 30%, 31%-49%, 50%-69%, 70%-89%, and 90% or higher. Alternatively, the electronic device may receive dangerous situation information from an external device and differently inform of the dangerous situation information according to a distance.

In this case, the electronic device may differently set at least one of sound information, voice information, and display information associated with the dangerous situation information according to the degree of danger, and may output at least one of the set sound information, voice information, and display information. For example, when the dangerous situation information corresponds to "icy road", "obstacles", or "collision", the electronic device may output a warning sound and display a warning message on a screen. When the dangerous situation information corresponds to merging section, crossroad, or congested section, the electronic device may display only the warning message without outputting the warning sound. The electronic device may display only the warning message on the screen when a forecast rate of the dangerous situation information is lower than 30%, and may output the warning sound and display the warning message on the screen when the forecast rate of the dangerous situation information is higher than or equal to 50%. Alternatively, when the forecast rate of the dangerous situation information is higher than or equal to 90%, the electronic device may output a louder warning sound than that of forecast rate 50%-89% and may display a different window from that of forecast rate 50%-89%.

Figure 2:
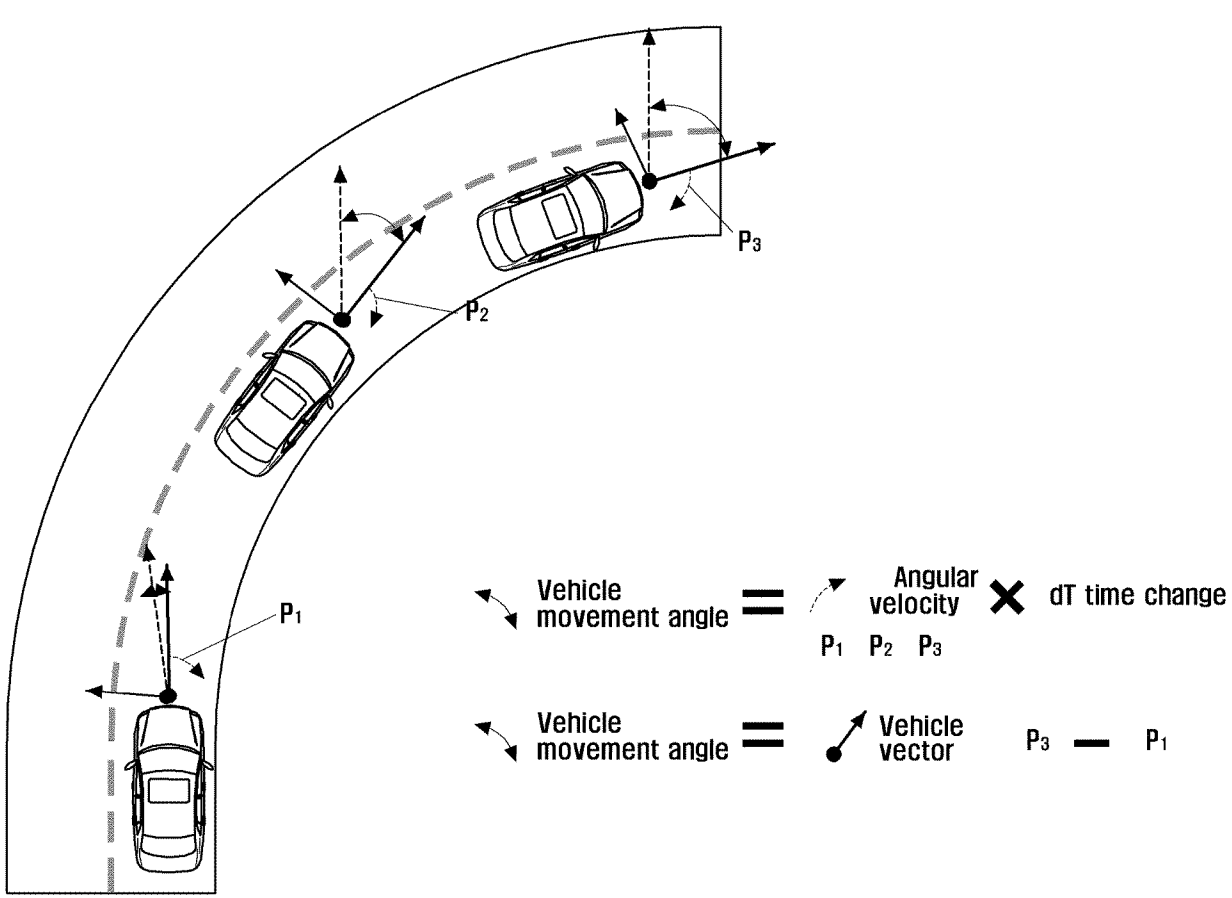
FIG. 2 illustrates an example of generating vector data according to various embodiments of the present disclosure.

FIG. 2 illustrates an example of generating vector data according to various embodiments of the present disclosure.

Referring to FIG. 2, the electronic device may generate, as vector data, a change amount of location information according to the lapse of time with respect to a vehicle located at a linear section P1. For example, in the linear section P1, bearing information 210 measured by the earth magnetic field sensor may point in a due north direction, and a difference between an angular velocity 220 and a vehicle progress angle 240 is slight. That is, since the due north direction pointed by the earth magnetic field sensor is equal to an angle 210 of the vehicle and an angle of vector data 230 in the linear section P1, the electronic device may generate, as the vector data, a change amount of location information according the lapse of time.

However, with respect to a vehicle located at a curve section P2 or P3, the electronic device may acquire an angle change amount of the vector data 230 by integrating a change amount of the angular velocity 220. That is, in the curve section, the angle change amount of the vector data 230 (angle change amount of vector data=angle−angular velocity x change amount of time) may be determined in consideration of an integral of the change amount of angular velocity 220 according to time (change amount of angular velocity=angular velocity−change amount of angle of vector data/change amount of time) and a change amount of an angle of the earth magnetic sensor. Accordingly, the electronic device may generate more accurate vector data using bearing information of the earth magnetic field sensor to correct an error of angular velocity information detected by the gyro sensor.

Figure 3:
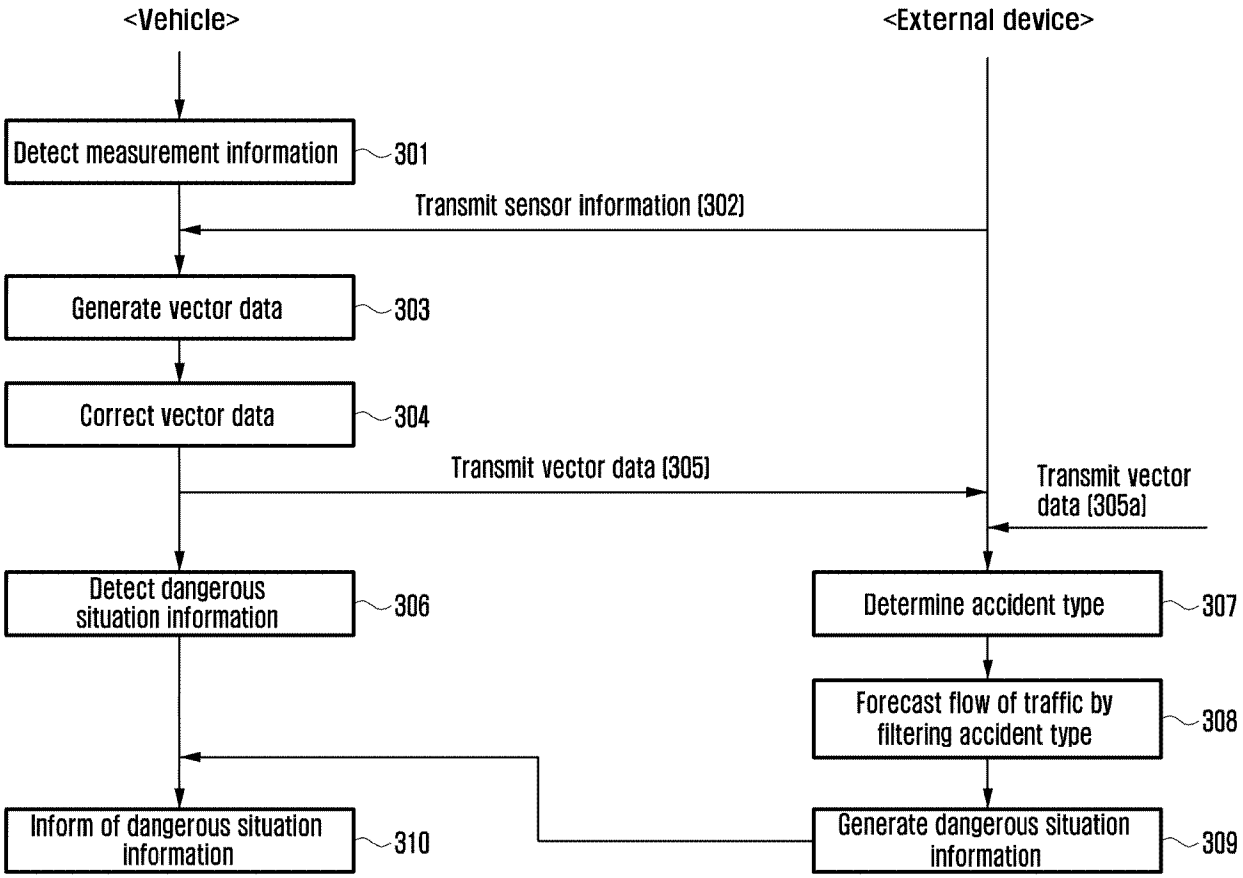
FIG. 3 is a flowchart illustrating a method of measuring vector data between a vehicle and an external device according to various embodiments of the present disclosure.

FIG. 3 is a flowchart illustrating a method of measuring vector data between a vehicle and an external device according to various embodiments of the present disclosure.

Referring to FIG. 3, in operation 301, the vehicle may detect measurement information of the vehicle using a sensor included in a pre-arranged electronic device. The electronic device may include at least one of a gyro sensor, a GPS sensor, and an acceleration sensor. The electronic device may detect at least one of angular velocity information of the vehicle, location information of the vehicle, and acceleration information of the vehicle using at least one of the gyro sensor, the GPS sensor, and the acceleration sensor.

In operation 302, the vehicle may receive sensor information from an external device. The external device may be one of a sensor installed in the vehicle, a sensor installed in another vehicle adjacent to the vehicle, and a vehicle forecast server. The vehicle may use the received sensor information as measurement information of the vehicle.

In operation 303, the vehicle may generate vector data based on the measurement information. The electronic device may generate the vector data using at least one of the angular velocity information, the location information, and the acceleration information.

In operation 304, the vehicle may correct the vector data using an earth magnetic field sensor. Alternatively, the vehicle may correct the vector data based on the sensor information.

In operation 305, the vehicle may transmit the generated vector data to the external device. In operation 305*a*, the external device may collect vector data from the vehicle or another vehicle.

In operation 306, the vehicle may detect dangerous situation information based on the sensor information.

In operation 307, the external device may determine an accident type based on the vector data. The external device may determine the accident type using at least one of a size, acceleration, and angular velocity of the vector data.

In operation 308, the external device may forecast the flow of traffic by filtering the accident type. The external device may filter the accident type based on at least one of road information, road history information, road condition information, weather information, and time information. The external device may generate vehicle vector data based on location information of the vehicle, calculate a difference between the vehicle vector data and location information of the vehicle using at least one of the characteristic, angular velocity, and acceleration of the vector data, and filter the accident type based on the calculated information. Alternatively, the external device may detect a vector pattern based on pieces of vector data of a plurality of vehicles and filter the accident type based on the vector pattern.

In operation 309, the external device may inform the vehicle of dangerous situation information associated with the flow of traffic.

In operation 310, the vehicle may inform of the detected dangerous situation information or the received dangerous situation information. At this time, the vehicle may compare the dangerous situation information with a preset degree of danger, and may differently inform of the dangerous situation information according to the corresponding degree of danger based on a result of the comparison. For example, the vehicle may differently set at least one of sound information, voice information, and display information associated with the dangerous situation information according to the degree of danger. The vehicle may output at least one of the set sound information, voice information, and display information.

Figure 4A:
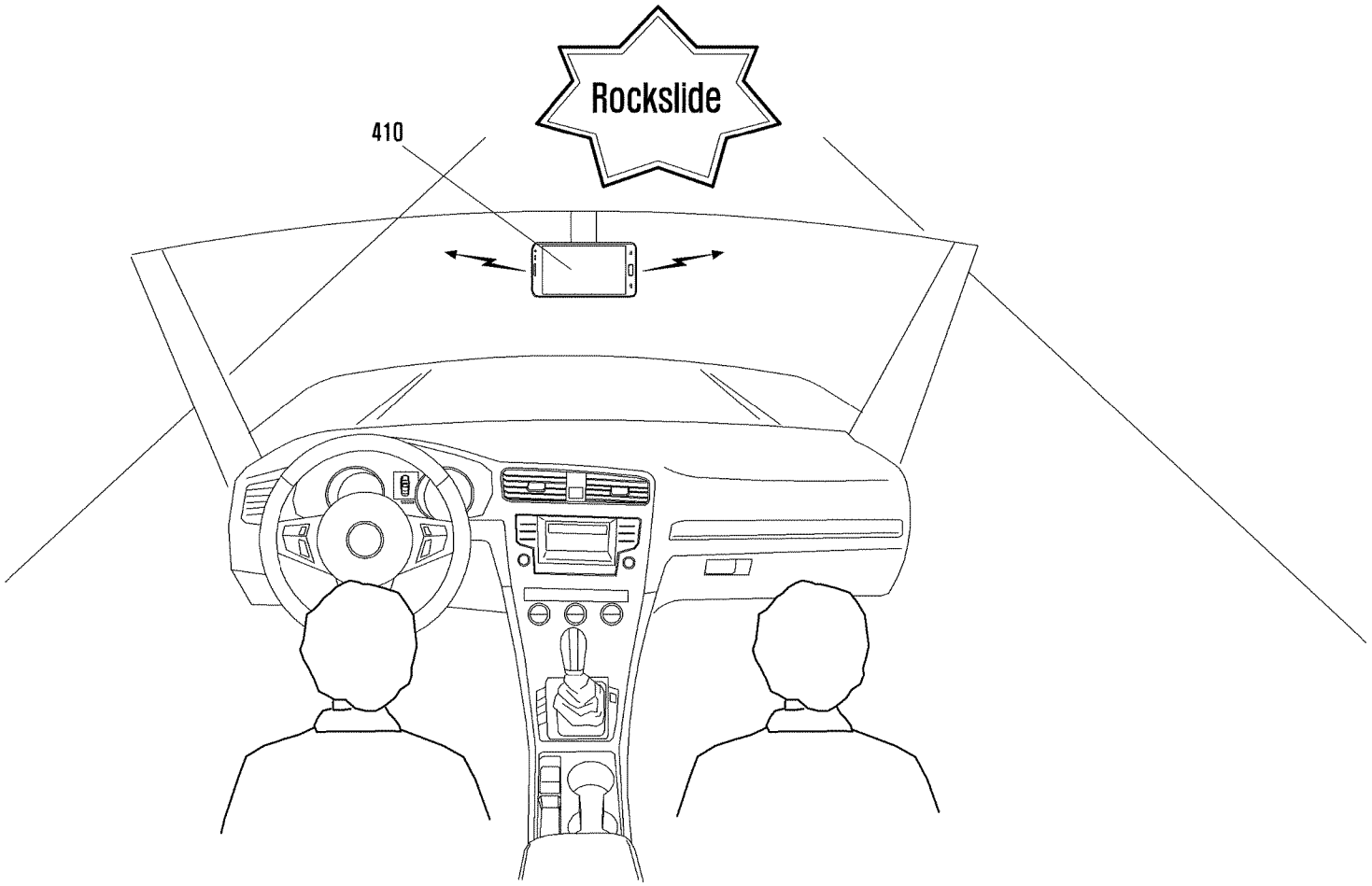
FIGS. 4A and 4B illustrate examples of informing of dangerous situation information according to various embodiments of the present disclosure.
Figure 4B:
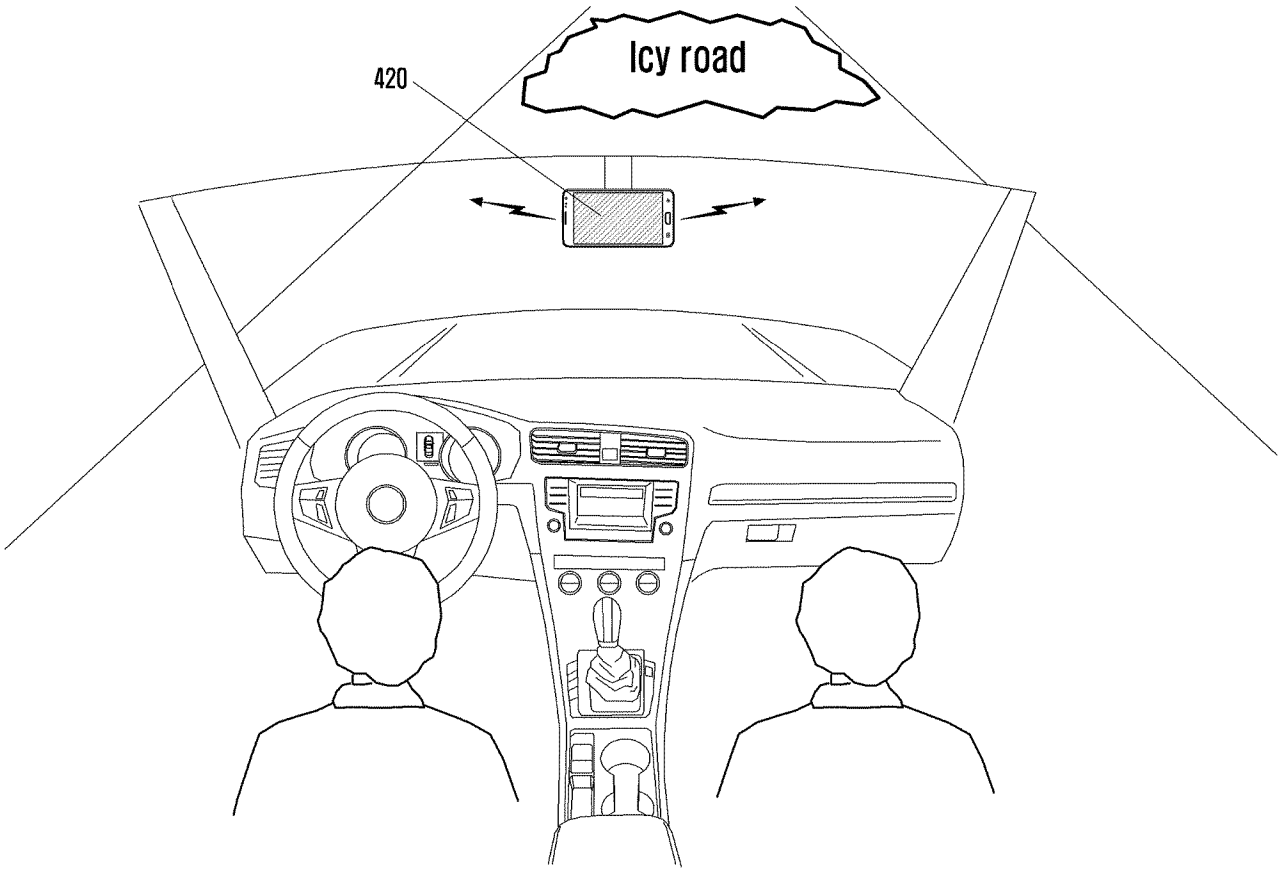

FIGS. 4A and 4B illustrate examples of informing of dangerous situation information according to various embodiments of the present disclosure.

Referring to FIG. 4A, the electronic device may be installed in a position within the vehicle which can be easily identified by a driver, for example, "the front window of the vehicle". The electronic device may differently set the degree of danger according to an accident type of the dangerous situation information such as icy road, obstacles, road damage, low speed section, collision, merging section, crossroad, and congested section. Alternatively, the electronic device may differently set the degree of danger according to a forecast rate of the dangerous situation information such as below 30%, 31%-49%, 50%-69%, 70%-89%, or 90% or higher. The electronic device may differently inform of the dangerous situation information according to the set degree of danger. For example, when a forecast rate of the dangerous situation information is 30% or lower, or when the type of the dangerous situation information is merging section, crossroad, or congested section, the electronic device may output a warning sound. The electronic device may also output the warning sound when an accident type is a "rockslide". Alternatively, referring to FIG. 4B, when the type of the dangerous situation information is icy road, obstacles, or collision, or when the forecast rate of the dangerous situation information is 50% or higher, the electronic device may output the warning sound and display a warning message on a screen at the same time. When displaying the warning message, the electronic device may allow the warning message to flicker.

Figure 5:
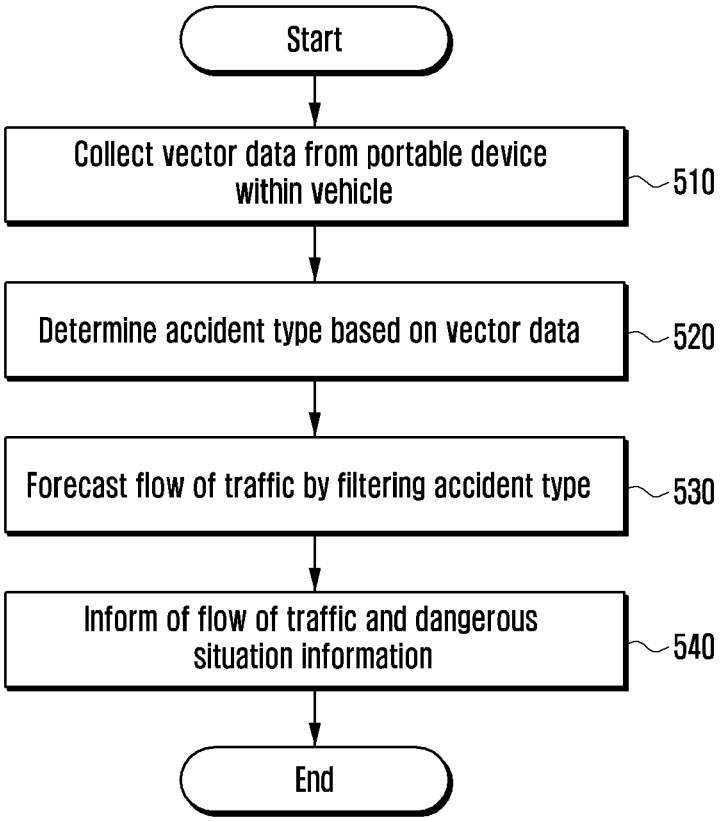
FIG. 5 is a flowchart illustrating a method of forecasting the flow of traffic according to various embodiments of the present disclosure.

FIG. 5 is a flowchart illustrating a method of forecasting the flow of traffic according to various embodiments of the present disclosure. The method of forecasting the flow of traffic may be performed by an electronic device within the vehicle or a vehicle forecast server. Hereinafter, for convenience of the description, the vehicle forecast server will be described as an "electronic device" and the electronic device within the vehicle will be described as a "portable device".

Referring to FIG. 5, in operation 510, the electronic device collects vector data from a portable device within the vehicle. The electronic device may collect vector data from a portable device which has joined a vehicle forecast service or a predetermined portable device located within a predetermined radius from an area where dangerous situation information is generated.

In operation 520, the external device may determine an accident type based on the vector data. The accident type may refer to classification of various types of all accidents and incidents which can influence the flow of traffic. For example, the accident type may include at least one of icy road, obstacles, road damage, low speed section, collision, merging section, crossroad, and congested section. The electronic device may determine the accident type by using at least one of a size, acceleration, and angular velocity of the vector data.

In operation 530, the electronic device may forecast the flow of traffic by filtering the accident type. The electronic device may filter the accident type based on at least one of road information, road history information, road condition information, weather information, and time information. The road information corresponds to characteristic information of the road and may include information indicating whether the road is a straight road, a curved road, and information on a speed limit on the road. The road history information may include information on accident histories of the road such as information indicating whether the road corresponds to an icy (icy road) section, a rockslide (obstacle) section, fog section, or a frequent accident section. The road condition information may include information on an accident section, a congested section, and a current vehicle speed which is reflected in real time. The weather information may include information on rain, snow, fog, temperature, and humidity. The time information may include information on day, night, way to work, way home from work, summer, and winter.

The external device according to various embodiments may generate vehicle vector data based on location information of the vehicle, calculate a difference between the vehicle vector data and location information of the vehicle by using at least one of the characteristic, angular velocity, and acceleration of the vector data, and filter the accident type based on the calculated information. The electronic device according to various embodiments may detect a vector pattern based on pieces of vector data of a plurality of vehicles and filter the accident type based on the vector pattern. The electronic device may reduce a data error by detecting the vector pattern of the vehicles based on the vector data of one or more vehicles rather than determining the accident type based on vector data of only one vehicle.

Accordingly, the electronic device may determine a more accurate accident type by collectively considering various pieces of information as well as the vector data.

In operation 540, the electronic device may inform of dangerous situation information associated with the flow of traffic. The dangerous situation information may include a degree of danger according to an accident type and a forecast rate. The electronic device may differently set the degree of danger according to an accident type such as icy road, obstacles, road damage, low speed section, collision, merging section, crossroad, or congested section. Alternatively, the electronic device may differently set the degree of danger according to a forecast rate of the dangerous situation information such as below 30%, 31%-49%, 50%-69%, 70%-89%, or 90% or higher. The electronic device may differently inform of the dangerous situation information according to the set degree of danger. For example, the electronic device may differently set at least one of sound information, voice information, and display information associated with the dangerous situation information according to the degree of danger, and may inform of the dangerous situation information by outputting at least one of the set sound information, voice information, and display information.

The electronic device according to various embodiments may calculate a distance from the vehicle based on location information of the dangerous situation information and informs a portable device within the vehicle of different dangerous situation information according to the distance. For example, the electronic device may set the degree of danger to be higher as the vehicle has a distance closer to the dangerous situation information. The electronic device may inform of the dangerous situation information by displaying a warning message on a screen when the distance is 100 m, displaying the warning message on the screen and outputting a warning voice at the same time when the distance is 50 m, and displaying the warning message and outputting the warning voice and a warning sound at the same time when the distance is 10 m.

Hereinafter, vector data of tables shown in FIGS. 6A to 15 may be generated as location information according to the lapse of time through the use of the GPS sensor. Alternatively, the vector data may be generated using at least one of the angular velocity information, the location information, and the velocity information. Alternatively, the vector data may be vector data having corrected bearing information through the use of the earth magnetic sensor.

Figure 6A:
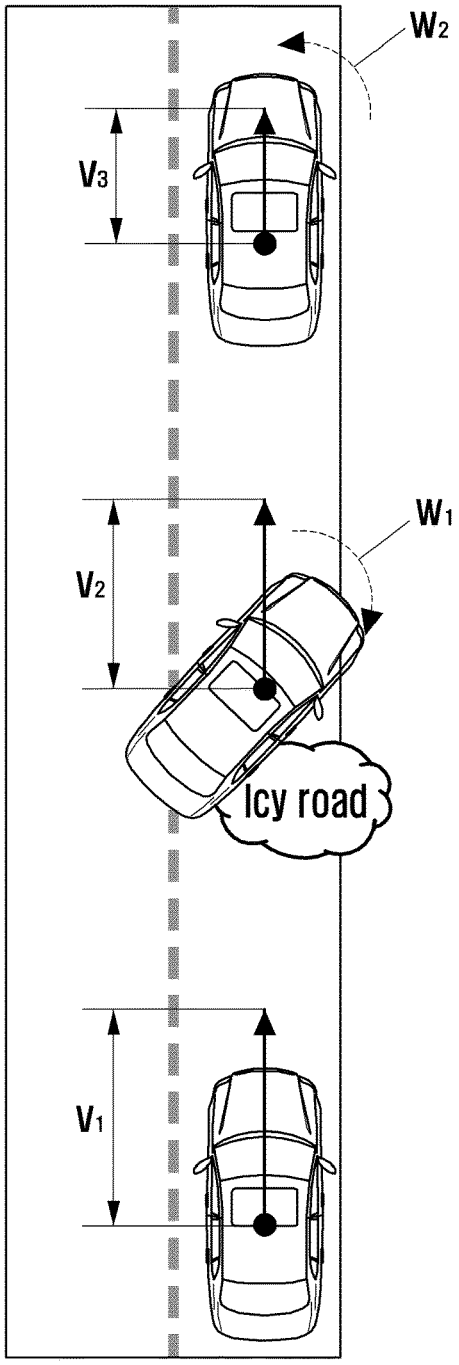

FIGS. 6A and 6B illustrate an example of determining whether an accident type corresponds to an icy road according to various embodiments of the present disclosure.

Referring to FIGS. 6A and 6B, the electronic device may determine the accident type as the "icy road" with reference to a change amount according to measurement information including vector data, acceleration information, and angular velocity information. The icy road may correspond to an accident type such as an icy road or a slide in which the vehicle has passed an accident section but has an angular velocity change. At this time, the electronic device may determine the accident type with reference to change amounts of measurement information in a position section (entrance) before the accident happens, a position section (icy road) where the accident happens, and a position section (way out) after the accident happens. For example, the electronic device may determine the accident type as the "icy road" when nothing significant is not found in the entrance section, a change in vector data ($V_2<V_1$) or acceleration is slight but a change in an angular velocity ($W_1$) is not slight in the accident section, and sizes ($V_3<V_2<V_1$) of the vector data are reduced and the angular velocity changes in the way out section.

This is because, when a driver encounters an icy road while driving without recognizing the icy road, the vehicle rotates and has a change in the angular velocity ($W_1$). Further, by reducing the velocity ($V_2<V_1$) of the vehicle in order to decrease the rotation, the size of the vector data may be somewhat reduced. When the driver escapes the icy road, the angular velocity may return the direction changed due to the rotation on the icy road to the original direction. Accordingly, the electronic device may determine the accident type in consideration of at least one of the size of the vector data, the direction of the vector data, acceleration information, and angular velocity information.

Figure 7A:
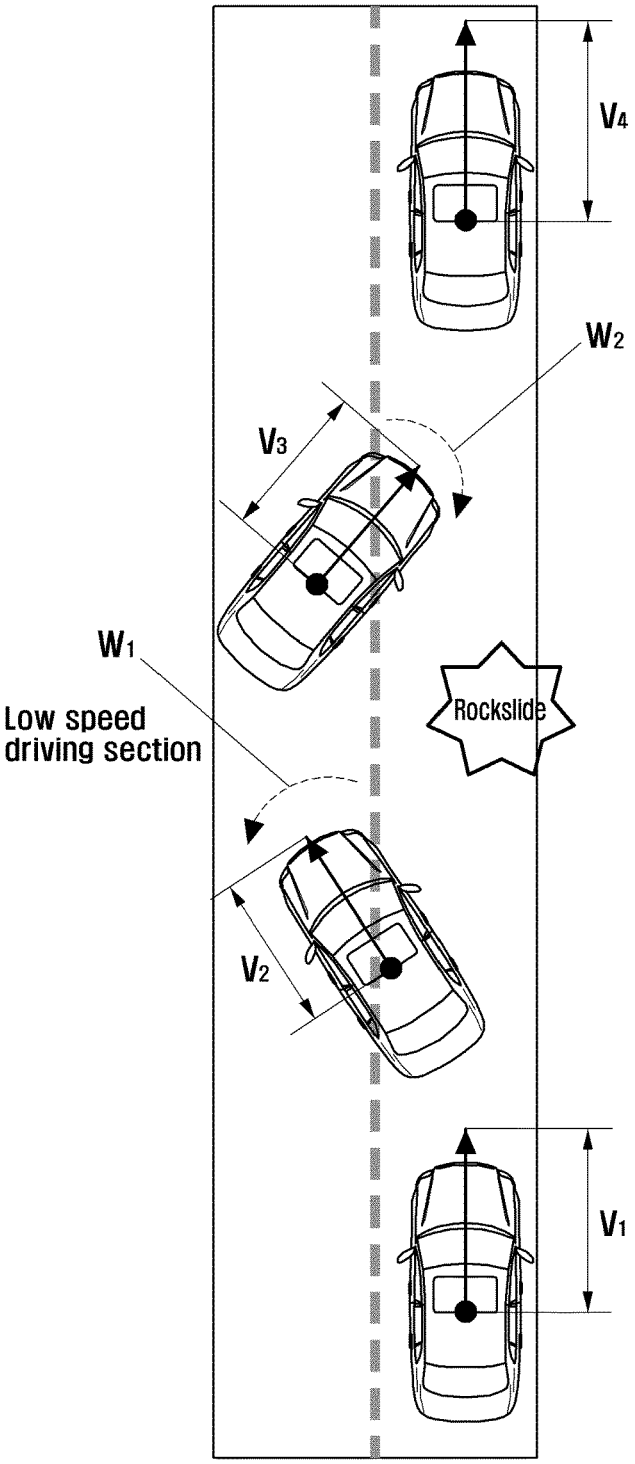

FIGS. 7A and 7B illustrate an example of determining whether an accident type corresponds to obstacles according to various embodiments of the present disclosure.

Referring to FIGS. 7A and 7B, the electronic device may determine the accident type as the "obstacles" with reference to a change amount according to measurement information including vector data, acceleration information, and angular velocity information. The obstacles may correspond to an accident type such as a rockslide, wild animal, or landslide in which the vehicle cannot pass an accident section and must detour. At this time, the electronic device may determine the accident type as the "obstacles" when the size ($V_2<V_1$) of the vector data is reduced and the acceleration is also reduced in the entrance section, the directions ($V_2$ and $V_3$) of the vector data change and angular velocities ($W_1$ and $W_2$) change in the accident section, and the size ($V_4>V_3$) of the vector data and the acceleration increase in the way out section.

This is because a driver who finds obstacles in the entrance section may prepare to change lanes while reducing velocity to avoid the obstacles. Further, the driver may change lanes while driving at a low speed to avoid an area where the obstacles are located in the accident section. In addition, the driver may change lanes again and increase speed in the way out section. Accordingly, the electronic device may determine the accident type as the "obstacles" in consideration of at least one of the size of the vector data, the direction of the vector data, acceleration information, and angular velocity information.

Figure 8A:
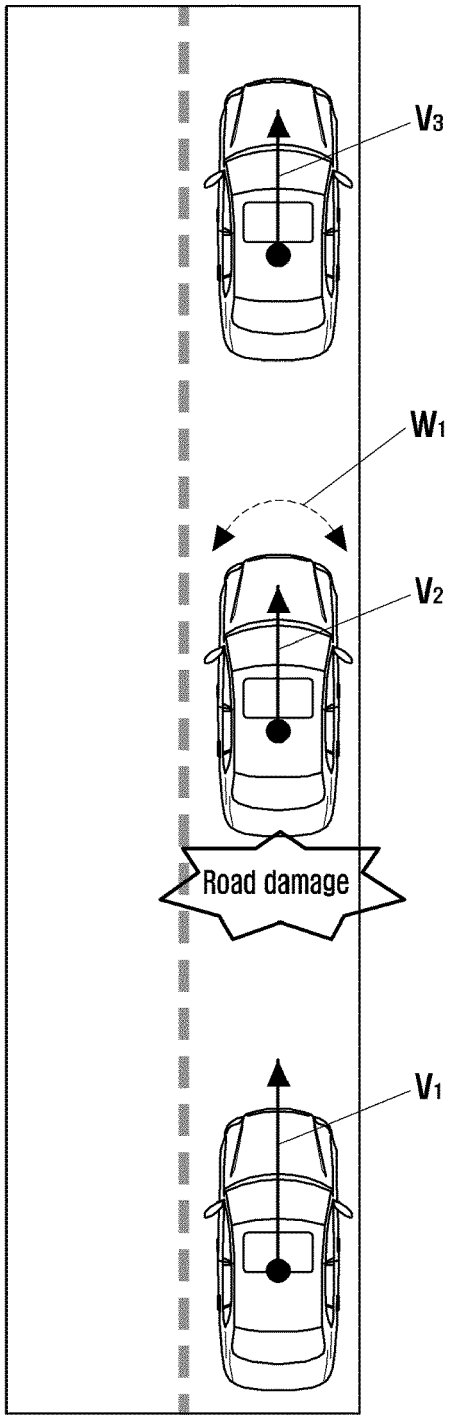

FIGS. 8A and 8B illustrate an example of determining whether an accident type corresponds to road damage according to various embodiments of the present disclosure.

Referring to FIGS. 8A and 8B, the electronic device may determine the accident type as the "road damage" with reference to a change amount according to measurement information including vector data, acceleration information, and angular velocity information. The road damage may correspond to an accident type in which the vehicle passes an accident section where the road is damaged or the road conditions are bad, but speed decreases or change in the angular velocity is slight. At this time, the electronic device may determine the accident type as the "road damage" when there is no change in the entrance section, there are small changes in the size ($V_2<V_1$) of the vector data and in the angular velocity ($W_1$) and a small change in the reduction of the acceleration in the accident section, and the size of the vector data and the acceleration slightly increase or remain the same in the way out section.

This is because a driver who finds the road damage in the entrance section may reduce speed slightly in order to minimize vehicle damage due to the road damage or may enter without seeing the road damage. Further, there may be an impact in a ground direction in the accident section, and an acceleration change may be generated in the ground direction due to the impact. In the way out section, the speed may increase slightly or remain the same. Accordingly, the electronic device may determine the accident type as the "road damage" in consideration of at least one of the size of the vector data, the direction of the vector data, acceleration information, and angular velocity information.

Figure 9A:
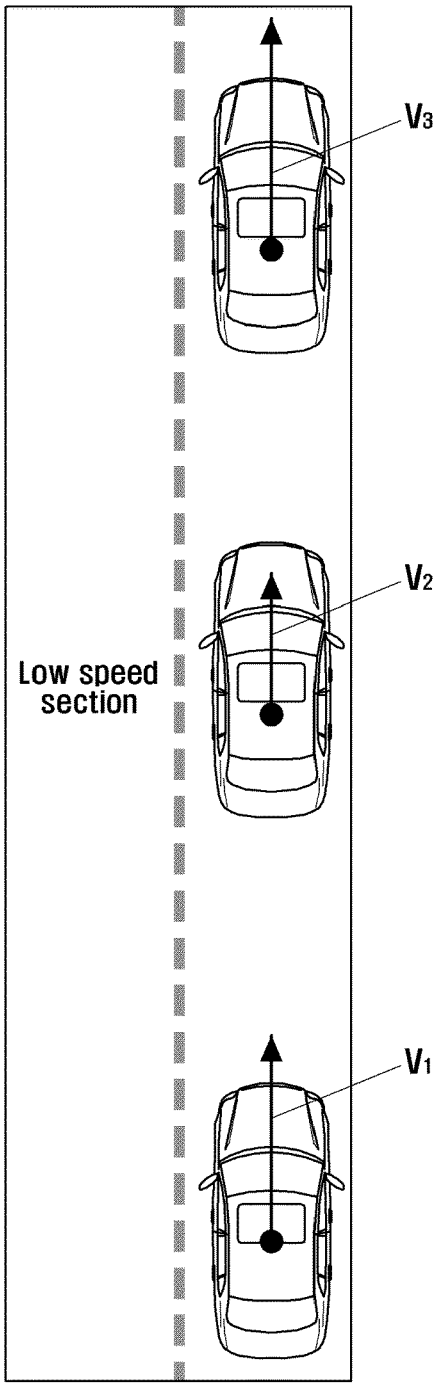

FIGS. 9A and 9B illustrate an example of determining whether an accident type corresponds to a low speed section according to various embodiments of the present disclosure.

Referring to FIGS. 9A and 9B, the electronic device may determine the accident type as the "low speed section" with reference to a change amount according to measurement information including vector data, acceleration information, and angular velocity information. The low speed section may correspond to an accident type in which the vehicle passes the accident section at a low speed due to an accident or road congestion but the speed of the vehicle does not reach an average speed. At this time, the electronic device may determine the accident type as the "low speed section" when there is no change in the entrance section, there is little change in the size ($V_2<V_1$) of the vector data and a change in the reduction of the acceleration in the accident section, and the size of the vector data and the acceleration slightly increase ($V_3>V_2$) or remain the same.

This is because a driver who finds a large number of vehicles in the accident section may reduce speed or change lanes so that an acceleration change may be generated. In the way out section, speed may increase slightly or remain the same. Accordingly, the electronic device may determine the accident type as the "low speed section" in consideration of at least one of the size of the vector data, the direction of the vector data, acceleration information, and angular velocity information.

Figure 10A:
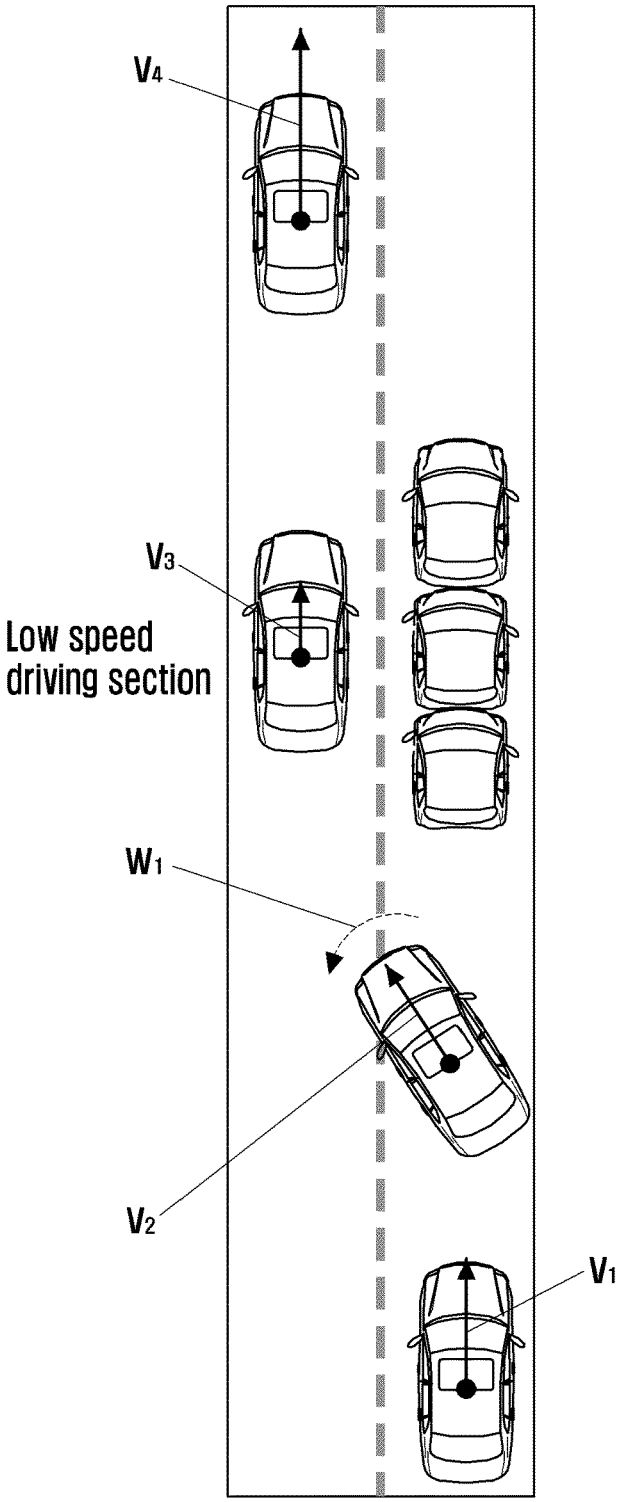

FIGS. 10A and 10B illustrate an example of determining whether an accident type corresponds to a collision according to various embodiments of the present disclosure.

Referring to FIGS. 10A and 10B, the electronic device may determine the accident type as the "collision" with reference to a change amount according to measurement information including vector data, acceleration information, and angular velocity information. The collision may correspond to an accident type in which the vehicle passes the accident section at a low speed due to an accident or road congestion but the speed of the vehicle is low and does not reach an average speed. At this time, the electronic device may determine the accident type as the "collision" when the size ($V_2<V_1$) of the vector data is reduced in the entrance section, the direction of the vector data change and the angular velocity ($W_1$) change in the accident section, and the size ($V_4>V_3$) of the vector data and the acceleration increases in the way out section.

This is because a driver who finds the collision in the entrance section may reduce speed in order to detour a collision area. Further, since the vehicle detours the collision area in the accident section, the direction or angular velocity of the vector data may change. In the way out section, the speed may increase a little or remain the same. Accordingly, the electronic device may determine the accident type as the "collision" in consideration of at least one of the size of the vector data, the direction of the vector data, acceleration information, and angular velocity information.

Figure 11A:
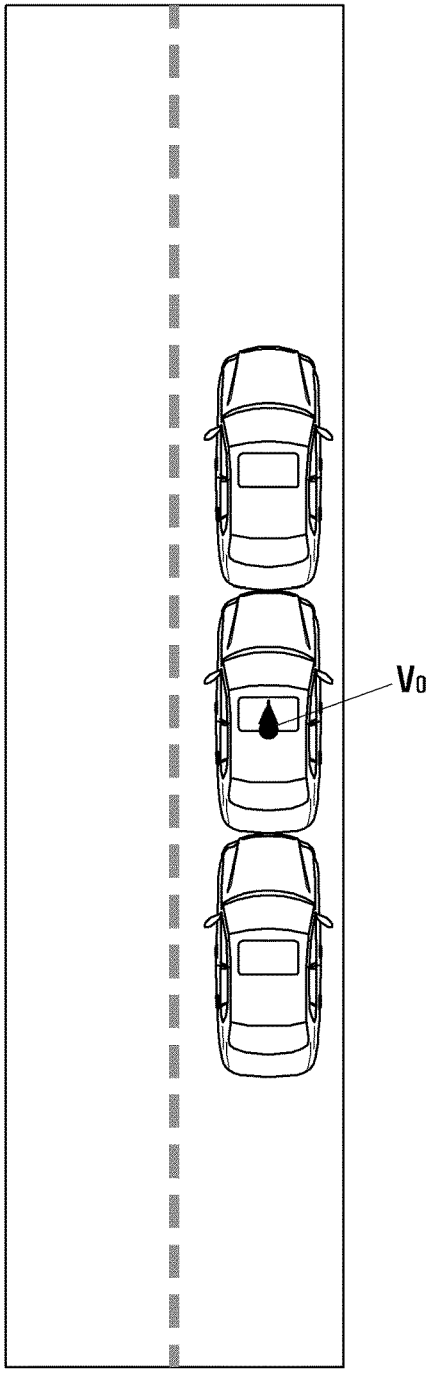

FIGS. 11A and 11B illustrate another example of determining whether an accident type corresponds to a collision according to various embodiments of the present disclosure.

Referring to FIGS. 11A and 11B, the electronic device may determine the accident type as the "collision" with reference to a change amount according to measurement information including vector data, acceleration information, and angular velocity information. The party to the collision may stop in an area where the collision occurs. At this time, the electronic device may determine the accident type as the "collision" when the size of the vector data rapidly decreases ($V_0$) and there is a movement direction acceleration impact in the accident section.

Figure 12A:
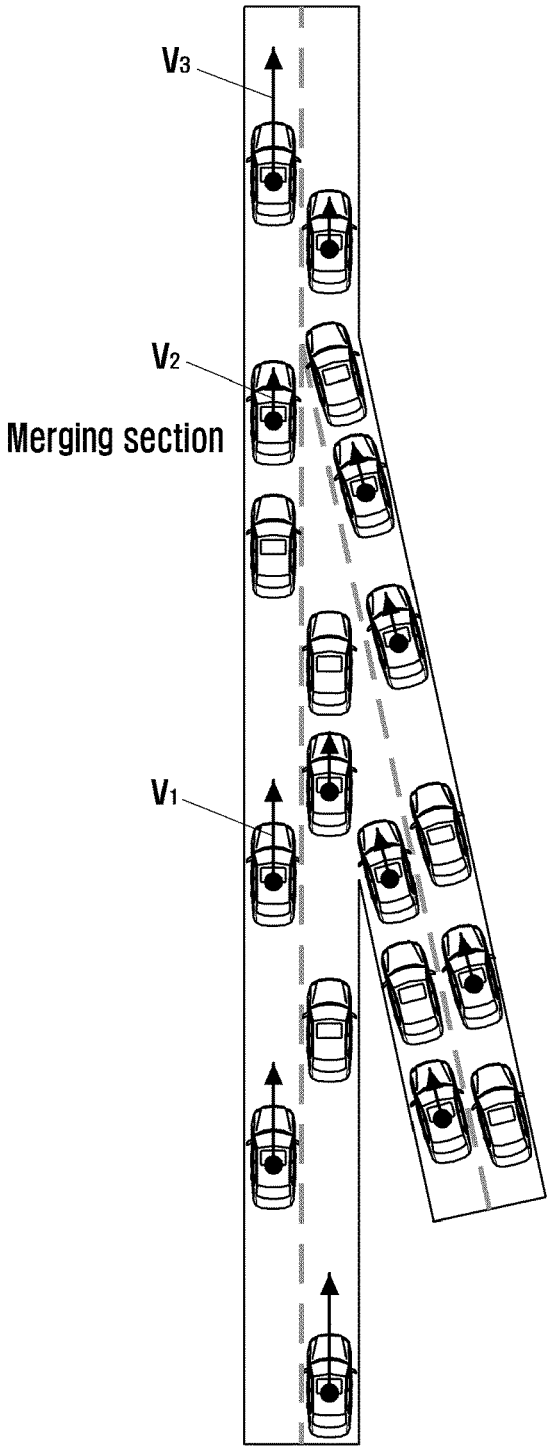

FIGS. 12A and 12B illustrate an example of determining whether an accident type corresponds to a merging section according to various embodiments of the present disclosure.

Referring to FIGS. 12A and 12B, the electronic device may determine the accident type as the "merging section" with reference to a change amount according to measurement information including vector data, acceleration information, and angular velocity information. The merging section may correspond to an accident type in which the vehicle passes the accident section at a low speed due to a rapid increase in vehicles or road congestion but the speed of the vehicle is low and does not reach an average speed. At this time, the electronic device may determine the accident type as the "merging section" when the size ($V_2<V_1$) of the vector data is reduced in the entrance section, the size ($V_2$) of the vector data is reduced and the angular velocity ($W_1$) changes in the accident section, and the size ($V_3>V_2$) of the vector data and the acceleration increase in the way out section and when two or more vehicle vectors are combined into one vector.

This is because a driver who finds a large number of vehicles in the accident section may reduce speed or change lanes so that an angular velocity change may be generated. In the way out section, speed may increase slightly or remain the same. Accordingly, the electronic device may determine the accident type as the "merging section" in consideration of at least one of the size of the vector data, the direction of the vector data, acceleration information, and angular velocity information.

Figure 13A:
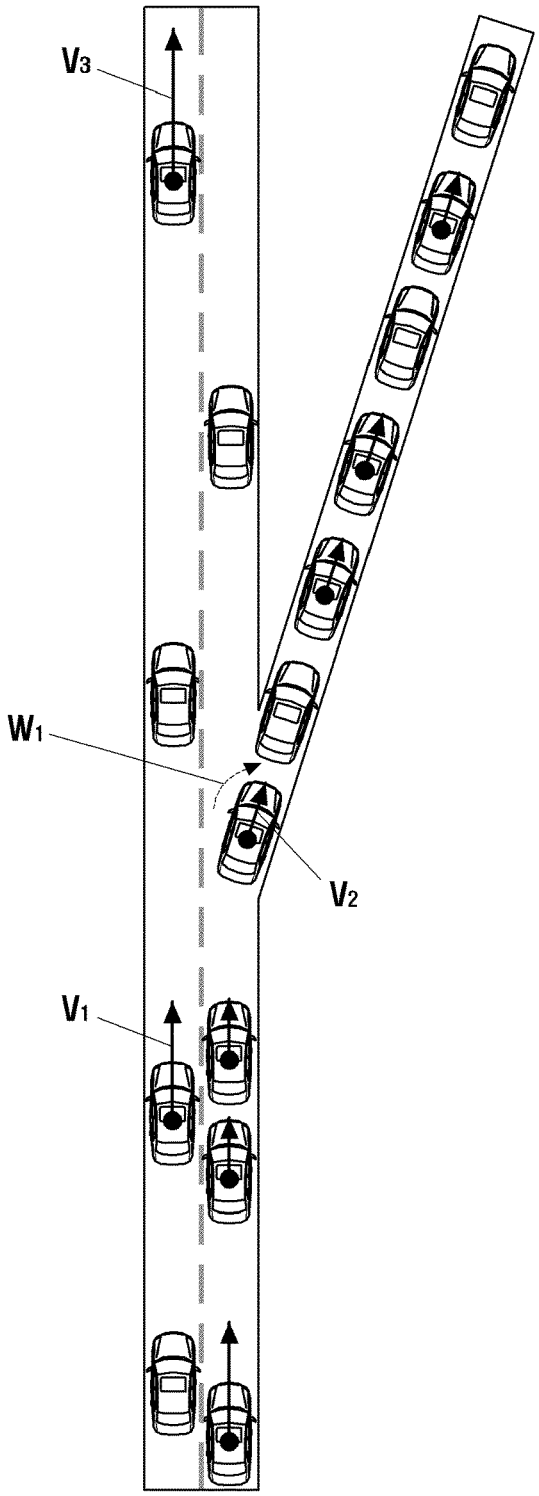

FIGS. 13A and 13B illustrate examples of determining whether an accident type corresponds to a crossroad according to various embodiments of the present disclosure.

Referring to FIGS. 13A and 13B, the electronic device may determine the accident type as the "crossroad" with reference to a change amount according to measurement information including vector data, acceleration information, and angular velocity information. The crossroad may be an accident type in which the vehicle passes the accident section at a low speed due to an increase in frequency of rotations of the vehicle but the speed is lower than an average speed. At this time, the electronic device may determine the accident type as the "crossroad" when the size ($V_2<V_1$) of the vector data is reduced in the entrance section, the size ($V_2$) of the vector data is reduced and the angular velocity ($W_1$) changes in the accident section, and the size ($V_3$) of the vector data and the acceleration increase in the way out section and when one vehicle vector is divided into two or more vectors.

Figure 14A:
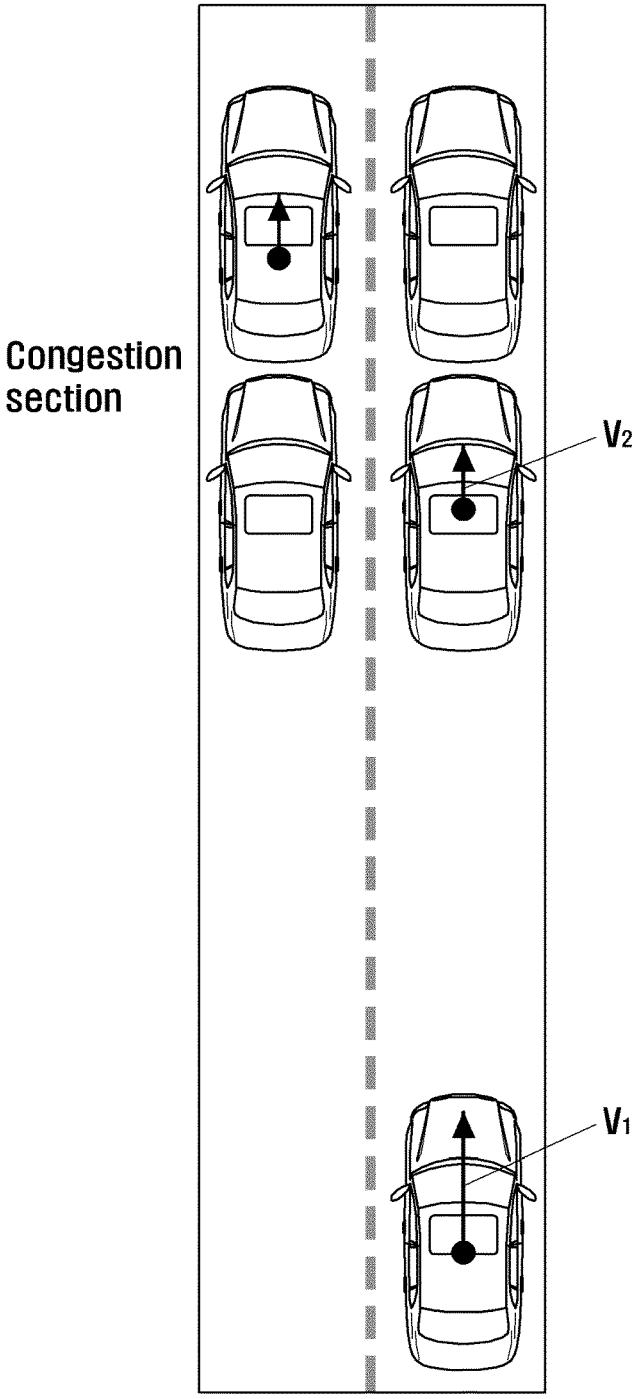

FIGS. 14A and 14B illustrate an example of determining whether an accident type corresponds to a congested section according to various embodiments of the present disclosure.

Referring to FIGS. 14A and 14B, the electronic device may determine the accident type as the "congested section" with reference to a change amount according to measurement information including vector data, acceleration information, and angular velocity information. The congested section may be an accident type in which the vehicle passes the accident section at a low speed due to an increase in vehicles but the speed is lower than an average speed. At this time, the electronic device may determine the accident type as the "congested section" when the size ($V_2<V_1$) of the vector data is reduced in the entrance section, and the size ($V_2$) of the vector data is constant without any change in the accident section.

The low speed section, the merging section, the crossroad, and the congested section which are described above may have similar vector data, acceleration information, and angular velocity information. In this case, the electronic device may filter the accident type based on at least one of road information, road history information, road condition information, weather information, and time information, so as to determine a more accurate accident type.

FIG. 15 illustrates an example of an accident type table according to various embodiments of the present disclosure.

Referring to FIG. 15, the electronic device may store an accident type table indicating change amounts of vector data, acceleration information, and angular velocity information according to each accident type. For example, when the vector data is reduced in the entrance section, the electronic device may primarily determine the obstacles, low speed section, collision, merging section, crossroad, and congested section as the accident types. The electronic device may filter the primarily determined accident types based on at least one of road information, road history information, road condition information, weather information, and time information. For example, when the road information of the entrance section corresponds to a "curve section" or the road history information corresponds to a "frequent accident section", the electronic device may determine the "collision" as the flow of traffic among the primarily determined accident types. In this case, the electronic device may inform a vehicle which enters the entrance section of the "collision" as dangerous situation information.

Alternatively, when the direction of the vector data changes in the accident section, the electronic device may secondarily determine the collision as the accident type. When an angular velocity change is large in the accident section, the electronic device may determine the "collision" as the flow of traffic. In this case, the electronic device may inform a vehicle which enters the entrance section of the "collision" as dangerous situation information.

Figure 16:
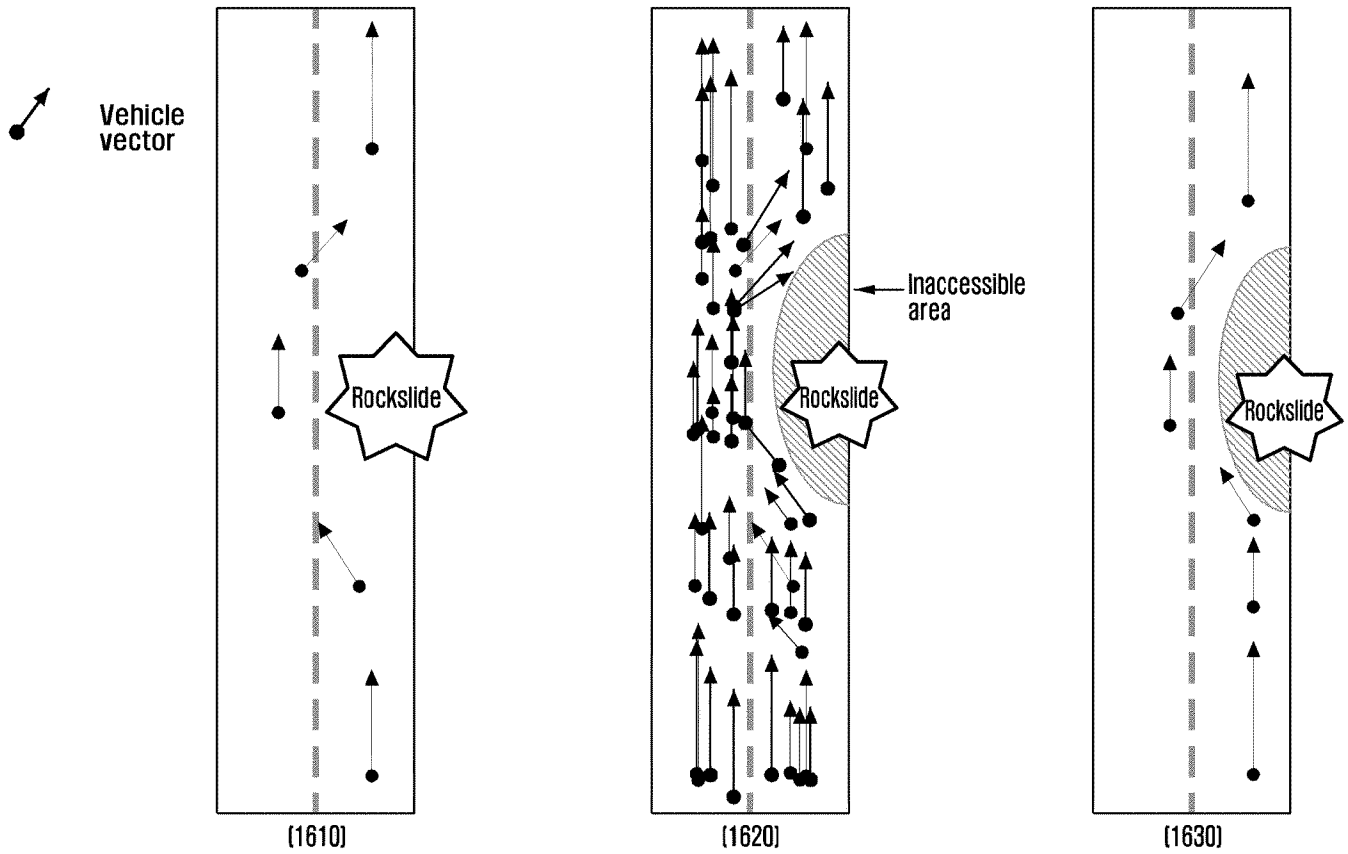
FIG. 16 illustrates an example of detecting a vector pattern based on vector data according to various embodiments of the present disclosure.

FIG. 16 illustrates an example of detecting a vector pattern based on vector data according to various embodiments of the present disclosure.

Referring to FIG. 16, the electronic device may primarily determine the accident type based on vector data of one vehicle as indicated by reference numeral 1610. Further, the electronic device may collect pieces of vector data of a plurality of vehicles as indicated by reference numeral 1620. The electronic device may detect a vector pattern based on the plurality of pieces of vector data as indicated by reference numeral 1630. Thereafter, the electronic device may filter the primarily determined accident type based on the vector pattern.

FIG. 17 is a filtering table according to various embodiments of the present disclosure.

Referring to FIG. 17, the electronic device may store a filtering table including at least one piece of road information (for example, curved road, straight road, speed limit or the like), road history information (for example, rockslide, landslide, icy or the like), road condition information (for example, collision or the like), weather information (for example, temperature, humidity, precipitation or the like), and time information (for example, day, night, summer, winter, date or the like) in the memory according to location information. The filtering table is used for filtering the accident type. The electronic device may determine the accident type by using at least one of the size of vector data, acceleration, and angular velocity collected from the vehicle, and may filter the determined accident type in consideration of the filtering table. For example, the location information may be marked using longitude and latitude. When determining the accident type based on location information (35.1, 127.3) of the vector data collected from the vehicle, the electronic device may filter the accident type in consideration of road information (straight road, 80 Km/h), road history information (a section where accidents occur frequently), weather information (clear), and time information (08:20 am). That is, when the accident types are primarily determined as the "rockslide", "collision", and "congestion" based on the location information, the electronic device may finally determine the accident type as the "collision" in consideration of the road history information corresponding to the section where accidents frequently happen, the weather information corresponding to clear, and the time information corresponding to morning. Accordingly, the electronic device may generate dangerous situation information associated with the flow of traffic as the "collision" and inform of the dangerous situation information of the "collision".

When determining the accident type based on location information (37.2, 129.5) of the vector data collected from the vehicle, the electronic device may filter the accident type in consideration of road information (curve road, 50 Km/h), road history information (icy), weather information (below −2 degrees, snow), and time information (17:50 pm). That is, when the accident types are primarily determined as the "rockslide" and "icy" based on the location information, the electronic device may finally determine the accident type as the "icy" in consideration of the road history information corresponding to icy, the weather information corresponding to the temperature and snow, and the time information corresponding to night. Accordingly, the electronic device may generate dangerous situation information associated with the flow of traffic as the "icy" and inform of the dangerous situation information of the "icy".

When determining the accident type based on location information (38.3, 131.5) of the vector data collected from the vehicle, the electronic device may filter the accident type in consideration of road information (straight road, 50 Km/h), road history information (skid in the rain), road condition information (collision), weather information (0 degrees, 10 mm of precipitation), and time information (13:10 pm). That is, when the accident types are primarily determined as the "rockslide" and "collision" based on the location information, the electronic device may finally determine the accident type as the "collision" in consideration of the road history information corresponding to the skid in the rain, the road condition information corresponding to the collision, and the weather information corresponding to 10 mm of precipitation. Accordingly, the electronic device may generate dangerous situation information associated with the flow of traffic as the "collision" and inform of the dangerous situation information of the "collision".

When determining the accident type based on location information (36.2, 129.1) of the vector data collected from the vehicle, the electronic device may filter the accident type in consideration of road information (curve road, 30 Km/h), road history information (landslide), road condition information (congestion), weather information (below −5 degrees), and time information (11:10 am). That is, when the accident types are primarily determined as the "obstacles" and "congestions based on the location information, the electronic device may finally determine the accident type as the "rockslide (landslide)" in consideration of the road history information corresponding to the landslide, the road condition information corresponding to the congestion, and the weather information corresponding to −5 degrees. That is, when the location information corresponds to a mountainous area, the electronic device may reflect weather corresponding to low temperature of the mountainous area in the vector data to forecast the flow of traffic. Accordingly, the electronic device may generate dangerous situation information associated with the flow of traffic as the "landslide" and inform of the dangerous situation information of the "landslide".

When determining the accident type based on location information (35.7, 126.8) of the vector data collected from the vehicle, the electronic device may filter the accident type in consideration of road information (straight road, 100 Km/h), weather information (clear), and time information (11:20 am). That is, when the accident types are primarily determined as "congestion" and "road damage" based on the location information, the electronic device may finally determine the accident type as the "congestion" in consideration of road information, weather information, and time information. That is, when the time information includes holidays and there is no accident in the road condition information, the electronic device may determine simple congestion due to an increase in vehicles. Accordingly, the electronic device may generate dangerous situation information associated with the flow of traffic as the "congestion" and inform of the dangerous situation information of the "congestion".

According to some embodiments, the electronic device may calculate a distance from the vehicle based on location information of the dangerous situation information and inform a portable device within the vehicle of different dangerous situation information according to the distance.

Figure 18:
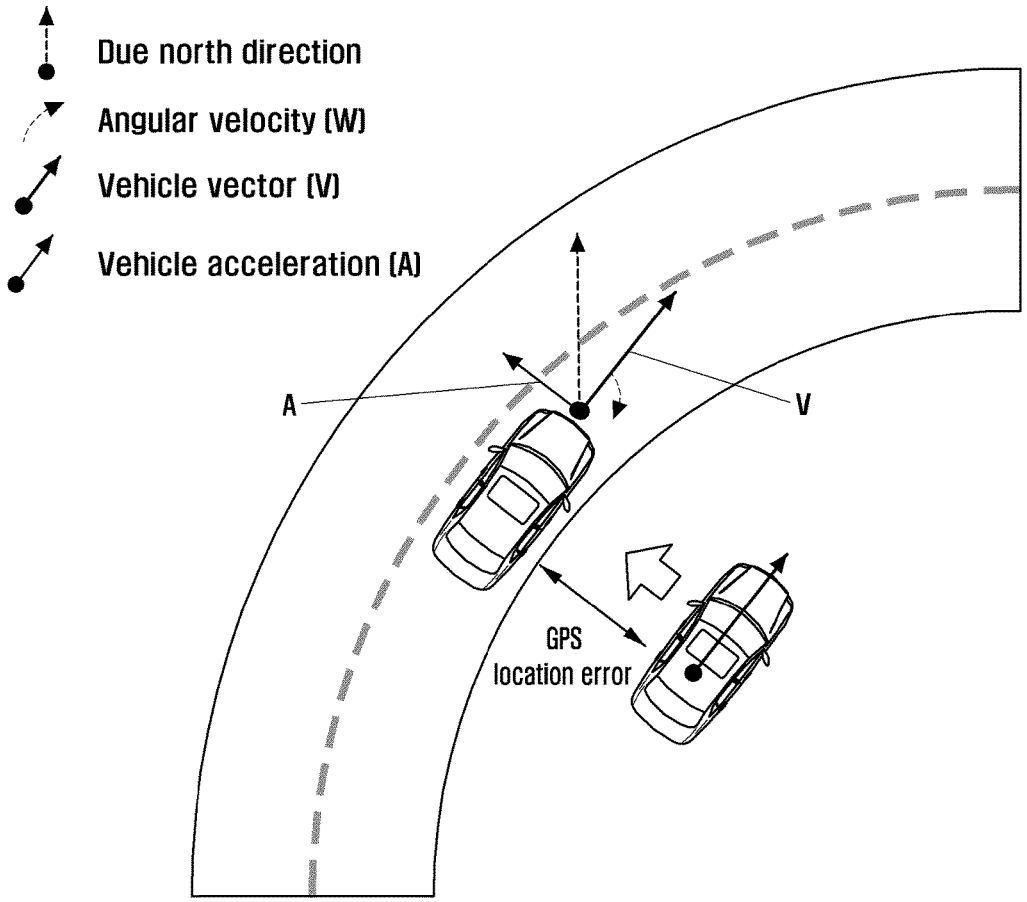
FIG. 18 illustrates an example of detecting a sensor error according to various embodiments of the present disclosure.

FIG. 18 illustrates an example of detecting a sensor error according to various embodiments of the present disclosure.

Referring to FIG. 18, the electronic device may acquire location information of the vehicle based on vector data collected from the vehicle. The vector data (V) may include at least one of a position change amount according to time, an angular velocity (W), and an acceleration (A). The electronic device may generate vehicle vector data based on location information of the vehicle and calculate sensor error information by using the vehicle vector data. Accordingly, although the vector is detected such that the vehicle passes an area which is not a road, the electronic device may determine that the vehicle passes on the road by considering a location information change amount of the vehicle such as an angular velocity, acceleration or the like. Further, the electronic device may filter the accident type based on the calculated vehicle location information.

Figure 19A:
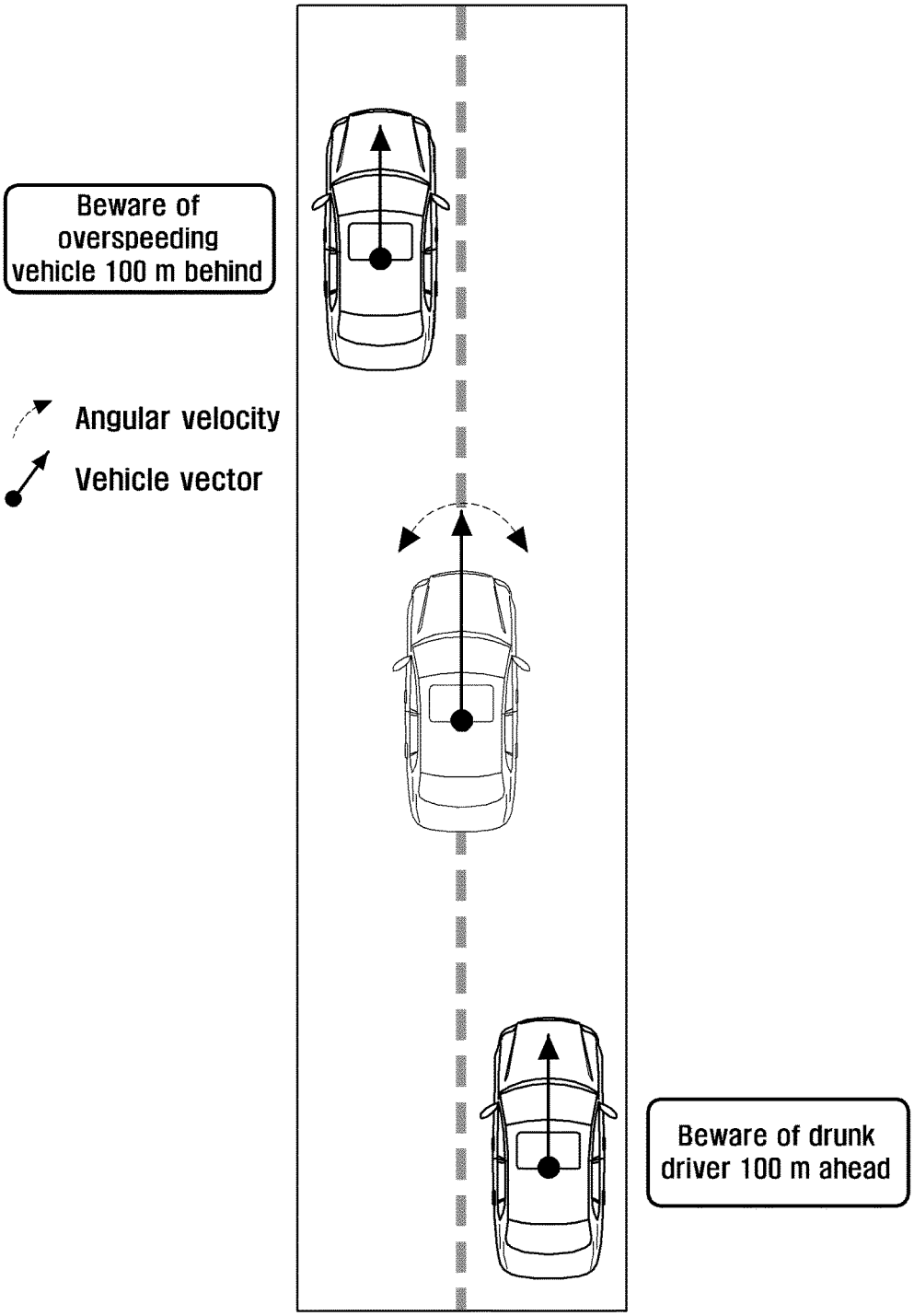

FIGS. 19A and 19B illustrate an example of detecting danger elements according to various embodiments of the present disclosure.

Referring to FIGS. 19A and 19B, the electronic device may collect vector data from a vehicle which has joined a vehicle forecast service or another vehicle within a predetermined range from the vehicle having joined the vehicle forecast service. When the vector data of the other vehicle has a size change, an acceleration increase, and an angular velocity change based on the vector data collected from the other vehicle, the electronic device may forecast that the driver of the other vehicle is drunk driving or speeding. At this time, the electronic device may determine whether the other vehicle exceeds a speed limit based on road information (curved road, straight road, or speed limit). The electronic device may inform the vehicle that the driver of the other vehicle is drunk driving or speeding as dangerous situation information.

Figure 20:
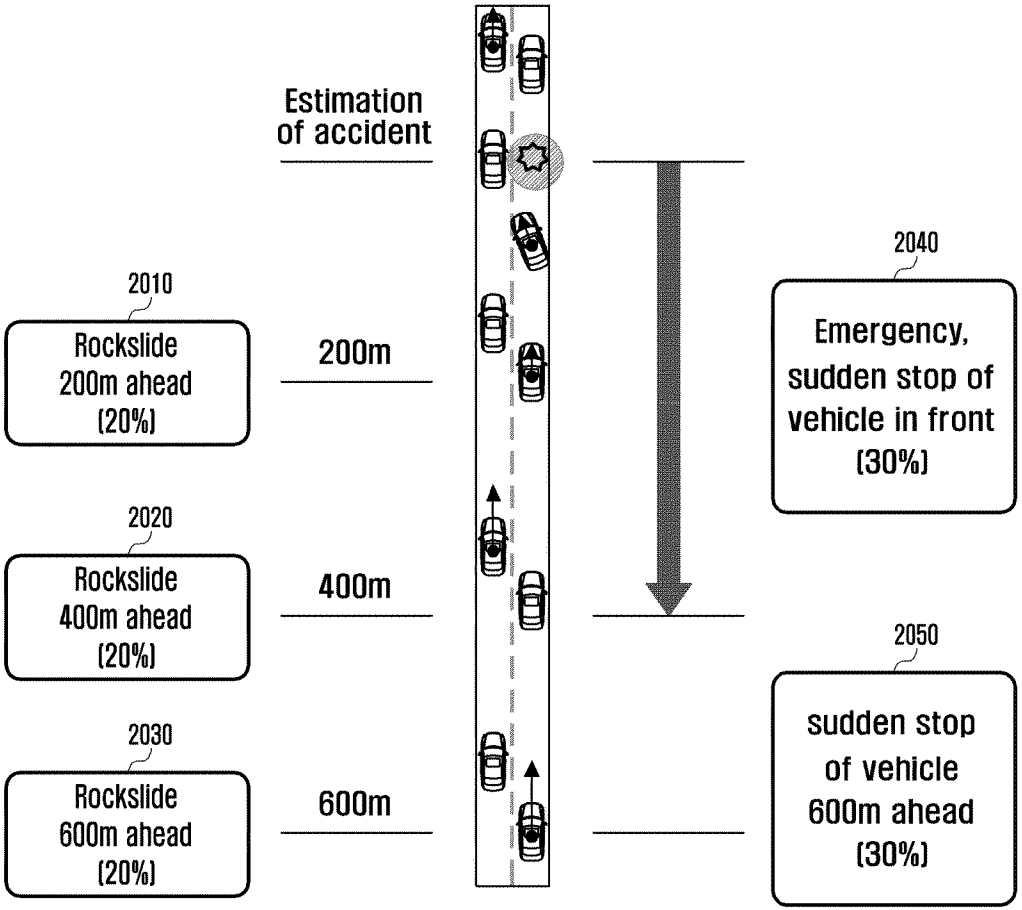
FIG. 20 illustrates an example of differently informing of dangerous situation information based on a distance according to various embodiments of the present disclosure.

FIG. 20 illustrates an example of differently informing of dangerous situation information based on a distance according to various embodiments of the present disclosure.

Referring to FIG. 20, the electronic device may calculate a distance from a vehicle which is informed of an accident occurring area and dangerous situation information and inform of different dangerous situation information according to the calculated distance. For example, the electronic device may inform a vehicle within 200 m from the accident occurring area of dangerous situation information (20% chance of rockslide 200 m ahead, 2010) associated with rockslide estimation. The electronic device may inform a vehicle within 400 m from the accident occurring area of dangerous situation information (20% chance of rockslide 400 m ahead, 2020) associated with rockslide estimation. The electronic device may inform a vehicle within 600 m from the accident occurring area of dangerous situation information (20% chance of rockslide 600 m ahead, 2030) associated with rockslide estimation.

Alternatively, the electronic device may inform the vehicle within 600 m from the accident occurring area of dangerous situation information (30% chance of a sudden stop 600 m ahead) associated with the sudden stop. The electronic device may inform the vehicle within 400 m from the accident occurring area of dangerous situation information (emergency, 30% chance of a sudden stop in front) associated with the sudden stop.

Figure 21:
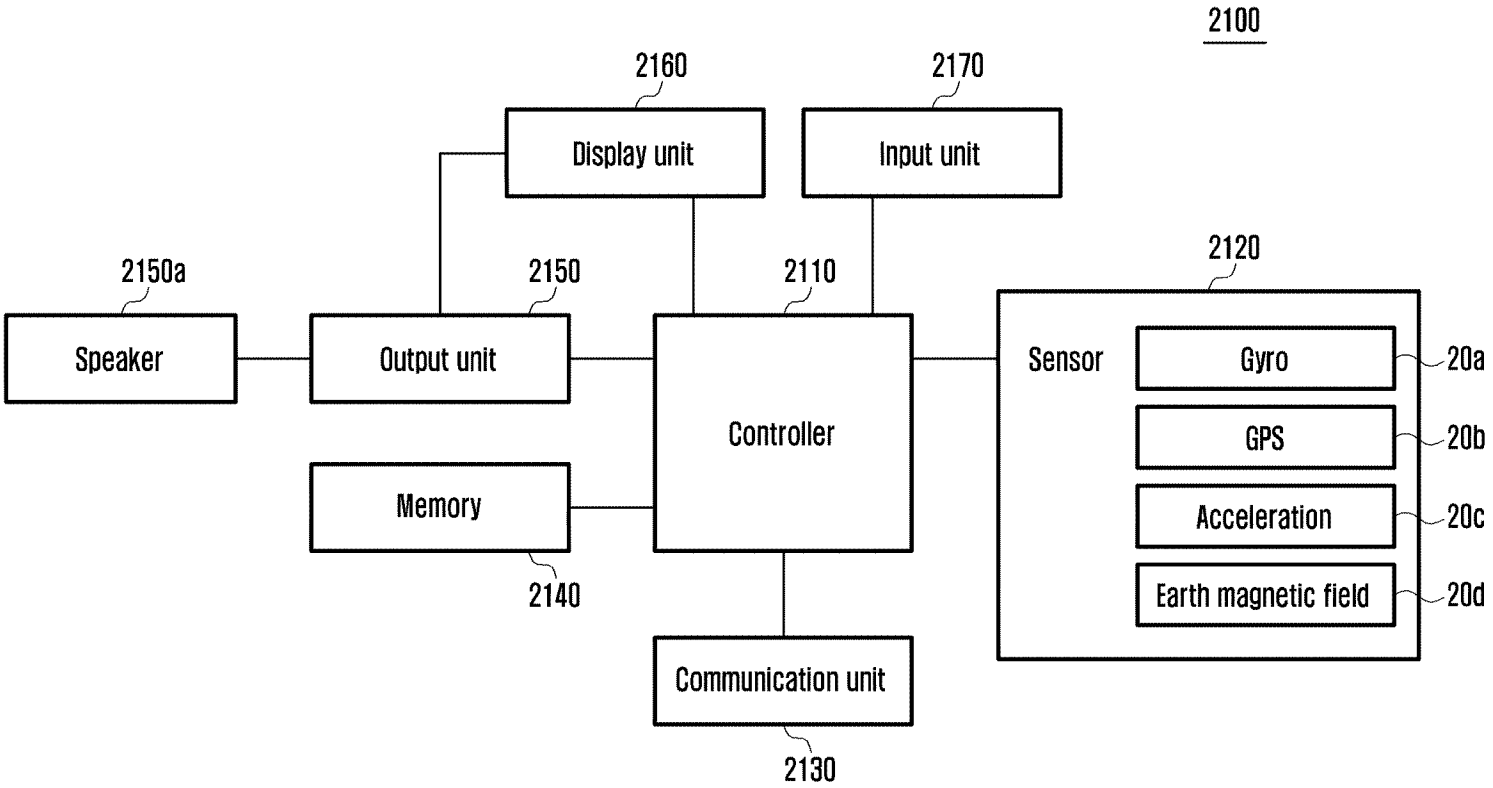
FIG. 21 is a block diagram illustrating an electronic device according to various embodiments of the present disclosure.

FIG. 21 is a block diagram of an electronic device according to various embodiments of the present disclosure.

Referring to FIG. 21, an electronic device 2100 may include a controller 2110, a sensor 2120, a communication unit 2130, a memory 2140, an output unit 2150, a display unit 2160, and an input unit 2170. The electronic device 2100 may be installed within a vehicle or may be a vehicle forecast server.

First, an example of installing the electronic device 2100 within the vehicle will be described.

The sensor 2120 may detect measurement information of the vehicle. The sensor 2120 may include at least one of a gyro sensor 20*a*, a GPS sensor 20*b*, an acceleration sensor 20*c*, and an earth magnetic field sensor 20*d*. The gyro sensor 20*a* may detect angular velocity information of the vehicle. The GPS sensor 20*b* may detect location information of the vehicle. The acceleration sensor 20*c* may detect acceleration information of the vehicle.

The controller 2110 may generate vector data based on the measurement information. For example, the controller 2110 may generate the vector data by using at least one of the angular velocity information, the location information, and the acceleration information. According to any embodiment, the controller 2110 may correct the vector data using the earth magnetic field sensor 20*d*. The controller 2110 may use sensor information received from a sensor installed in the vehicle or another vehicle adjacent to the vehicle through the communication unit 2130 as the measurement information of the vehicle or correct the vector data using the sensor information. The controller 2110 may detect dangerous situation information based on the sensor information and inform of the detected dangerous situation information. The controller 2110 may differently inform of the dangerous situation information received from an external device through the communication unit 2130 according to a distance.

The controller 2110 may compare the dangerous situation information with a preset degree of danger, and may differently inform of the dangerous situation information according to a corresponding degree of danger based on a result of the comparison. The controller 2110 may differently set at least one of sound information, voice information, and display information associated with the dangerous situation information according to the degree of danger, and may output at least one of the set sound information, voice information, and display information through the output unit 2150 or the display unit 2160.

The communication unit 2130 may transmit the vector data to the external device. Further, the communication unit 2130 may receive sensor information from a sensor installed in the vehicle or another vehicle adjacent to the vehicle. Alternatively, the communication unit 2130 may receive dangerous situation information from the external device. In general, the communication unit 2130 may perform a voice call, a video call, or data communication with the external device through a network under a control of the controller 2110. The communication unit 2130 includes a wireless frequency transmitter for upward converting and amplifying a frequency of a transmitted signal, and a wireless frequency receiver for downward converting and low-noise amplifying a frequency of the received signal. Further, the communication unit 2130 includes a mobile communication module (for example, 3rd generation mobile communication module, 3.5th generation mobile communication module, 4th generation mobile communication module or the like), a digital broadcasting module (for example, Digital Multimedia Broadcasting (DMB) module), and a short distance communication module (for example, Wi-Fi module, Bluetooth (BT) module, Near Field Communication (NFC) module).

The display unit 2160 may display the dangerous situation information (a warning message) on a screen. According to embodiments, the display unit 2160 displays at least one image on a screen under a control of the controller 2110. That is, when the controller 2110 processes (for examples, decodes) data as an image to be displayed on the screen and stores the image in a buffer, the display unit 2160 converts the image stored in the buffer to an analog signal and displays the analog signal on the screen. The display unit 2160 may be formed of a Liquid Crystal Display (LCD), OLED (Organic Light Emitted Diode), an Active Matrix Organic Light Emitted Diode (AMOLED), or a flexible display. The display unit 2160 according to the present disclosure may be implemented by a touch screen which can receive an input while displaying.

The output unit 2150 may output the dangerous situation information (for example, a warning sound or a warning voice). To this end, the output unit 2150 may include a speaker 2150*a* for outputting a warning sound or a warning voice, a vibration unit (not shown) for outputting a vibration, or a lighting unit (not shown) for outputting light. The lighting unit may output light when the dangerous situation information is output. The output unit 2150 may be an audio processor, and the audio processor may output a voice under a control of the controller 2110. In general, the audio processor may be combined with a speaker SPK and a microphone MIC to input and output an audio signal (for example, voice data) for a voice recognition, a voice recording, a digital recording, and a call. The audio processor receives an audio signal from the controller 2110, D/A-converts the received audio signal into an analog signal, amplifies the analog signal, and then outputs the analog signal to the speaker SPK. The speaker SPK converts the received audio signal to a sound wave and outputs the sound wave. The MIC converts sound waves transferred from a person or other sound sources into audio signals.

The memory 2140 may store an accident type table indicating change amounts of vector data, acceleration information, and angular velocity information according to each accident type. Further, the memory 2140 may store a filtering table including at least one of road information (for example, a curved road, a straight road, speed limit or the like), road history information (for example, rockslide, landslide, icy or the like), road condition information (for example, a collision or the like), weather information (for example, temperature, humidity, precipitation or the like), and time information (for example, day, night, summer, winter, date or the like). In general, the memory 2140 may store data such as pictures, documents, applications, and music, a value preset to the electronic device 2100, and set conditions. The memory 2140 is a secondary memory unit of the electronic device 2100 and may include a disk, a Random Access Memory (RAM), and a flash memory.

The input unit 2170 may include a plurality of keys for receiving numeric or character information and setting various functions. The keys may include a menu opening key, a screen on/off key, a power on/off key, a volume control key and the like. The input unit 2170 may generate a key event related to a user setting and a control of the function of the electronic device 2100 and transmit the generated key event to the controller 2110. The key event may include a power on/off event, a volume control event, a screen on/off event, a shutter event, and the like. The controller 2110 controls the above-mentioned components in response to such key events. Meanwhile, keys of the input unit 2170 may be referred to as hard keys, and virtual keys displayed on the display unit 2160 may be referred to as soft keys.

Next, an example of installing the electronic device 2100 in the vehicle forecast server will be described. Hereinafter, overlapping descriptions of the components will be omitted.

The communication unit 2130 may collect vector data from a portable device within the vehicle.

The controller 2110 may determine an accident type based on the vector data and filter the accident type to forecast the flow of traffic. The controller 2110 may filter the accident type based on at least one of road information, road history information, road condition information, weather information, and time information. The road information may include at least one of a curved section, a straight section, and a speed limit. The road history information may be a rockslide, a landslide, icy or the like. The road condition information may be a collision, congestion or the like. The weather information may be temperature information, humidity information, precipitation information, snow or the like. The time information may include day, night, summer, winter, date and the like.

According to various embodiments, the controller 2110 may generate vehicle vector data based on location information of the vehicle, calculate a difference between the vehicle vector data and location information of the vehicle by using at least one of the characteristic, angular velocity, and acceleration of the vector data, and filter the accident type based on the calculated information. According to various embodiments, the controller 2110 may detect a vector pattern based on pieces of vector data of a plurality of vehicles and filter the accident type based on the vector pattern.

According to various embodiments, the controller 2110 may generate dangerous situation information associated with the flow of traffic, calculate a distance from the vehicle based on location information of the dangerous situation information, and inform a portable device within the vehicle of different dangerous situation information according to the distance through the communication unit 2130. For example, the controller 2110 may set the degree of danger to be higher as the vehicle has a distance closer to the dangerous situation information. When the distance is within 100 m, the controller 2110 may inform of the dangerous situation information by displaying a warning message on a screen of the portable device within the vehicle. When the distance is within 50 m, the controller 2110 may inform of the dangerous situation information by displaying the warning message on the screen of the portable device within the vehicle and outputting a warning voice at the same time. When the distance is within 10 m, the controller 2110 may inform of the dangerous situation information by displaying the warning message on the screen, outputting the warning voice, and outputting a warning sound at the same time.

The embodiments disclosed in the present specifications and drawings were provided merely to readily describe and to help a thorough understanding of the present disclosure but not intended to limit the scope of the present disclosure. Therefore, it should be construed that all modifications or modified forms drawn by the technical idea of the present disclosure in addition to the embodiments disclosed herein are included in the scope of the present disclosure.

The invention claimed is:

1. A method using an electronic device installed in a vehicle, comprising:

detecting, by a sensor of the vehicle, a location and motion of the vehicle and generating measurement information indicative of the detected motion;

generating, by a processor of the electronic device, vector data aggregating the detected motion of the vehicle based on the measurement information;

transmitting, by a communication unit of the electronic device, the generated vector data to an external device that:

identifies at least two accident types matching the generated vector data from among a plurality of pre-stored accident types by comparing the generated vector data to a plurality of prestored vector data each associated with at least one of the plurality of prestored accident types, selects a final accident type from among the identified at least two accident types by detecting a match between one of the at least two accident types with the detected location of the vehicle, and retrieves pre-stored dangerous situation information including identification of at least one road hazard pre-associated with the selected final accident type; and receiving and outputting the retrieved dangerous situation information including notification of the at least one road hazard.

2. The method of claim 1, wherein detecting the measurement information comprises:

detecting angular velocity information of the vehicle using a gyro sensor;

detecting location information of the vehicle using a Global Positioning System (GPS) sensor; and detecting acceleration information of the vehicle using an acceleration sensor.

3. The method of claim 2, wherein the generating of the vector data comprises:

generating the vector data by using at least one of the angular velocity information, the location information, and the acceleration information; and correcting the vector data by using an earth magnetic field sensor.

4. The method of claim 1, wherein the generating of the vector data comprises:

receiving sensor information from a sensor installed in the vehicle or another vehicle adjacent to the vehicle; and using the sensor information as the measurement information of the vehicle or correcting the vector data by using the sensor information.

5. The method of claim 1, further comprising:

receiving sensor information from a sensor installed in the vehicle or another vehicle adjacent to the vehicle;

detecting dangerous situation information based on the sensor information; and informing of the detected dangerous situation information.

6. The method of claim 5, further comprising:

comparing the dangerous situation information with a preset degree of danger; and generation a notification for the dangerous situation information according to a corresponding degree of danger based on a result of the comparison.

7. The method of claim 6, wherein the notification includes at least one of sound information, voice information, and display information associated with the dangerous situation information according to the degree of danger; and outputting at least one of the sound information, voice information, and display information.

8. The method of claim 1, further comprising:

receiving dangerous situation information from the external device; and differently informing of the dangerous situation information according to a distance.

9. A method in an electronic device, comprising:

receiving, by a communication unit of the electronic device, vector data transmitted from a portable device disposed within a vehicle;

identifying at least two accident types matching the received vector data, from among a plurality of pre-stored accident types by comparison of the received vector data to a plurality of prestored vector data, each associated with at least one of the plurality of prestored accident types;

selecting a final accident type from among the identified at least two accident type by detecting a match between one of the identified at least two accident types with the detected location of the vehicle, and retrieving pre-stored dangerous situation information including identification of at least one road hazard pre-associated with the selected final accident type; and transmitting the retrieved pre-stored dangerous situation information to the portable device for notification of the at least one road hazard.

10. The method of claim 9, wherein the accident type is detected using at least one of a size, acceleration, and angular velocity of the vector data.

11. The method of claim 9, wherein selecting the final accident type further includes detecting a match between one of the identified at least two accident types with at least one of road information, road history information, road condition information, weather information, and time information corresponding to the matched detected location.

12. The method of claim 9, wherein generating the dangerous situation information comprises:

generating vehicle vector data based on location information of the vehicle;

calculating sensor error information by using the vehicle vector data; and generating, the accident type based on the calculated sensor error information among the selected final accident type, as the dangerous situation information.

13. The method of claim 9, wherein generating the dangerous situation information comprises:

detecting a vector pattern based on vector data of a plurality of vehicles; and generating, the accident type based on the vector pattern among the selected final accident type, as the dangerous situation information.

14. The method of claim 9, further comprising:

calculating a distance from the vehicle based on location information of the dangerous situation information; and generating a notification for output by a portable device based on the dangerous situation information when the calculated distance is equal to or less than a preset distance threshold.

15. An electronic device in a vehicle, comprising:

a sensor;

at least one processor; and a communication unit; and a memory including programming instructions executable by the at least one processor to cause the electronic device to:

detect, by the sensor, motion of the vehicle and generating measurement information indicative of the detected motion;

generate vector data aggregating the detected motion of the vehicle based on the measurement information;

transmit the generated vector data to an external device that:

identifies at least two accident types matching the generated vector data from among a plurality of pre-stored accident types by comparing the generated vector data to a plurality of prestored vector data, each associated with at least one of the plurality of prestored accident types, selects a final accident type from among the identified at least two accident types by detecting a match between one of the identified at least two accident types with the detected location of the vehicle, and retrieves pre-stored dangerous situation information including identification of at least one road hazard pre-associated with the selected final accident type; and receive and output the retrieved dangerous situation information including notification of the at least one road hazard.

16. The electronic device of claim 15, wherein the sensor includes at least one of a gyro sensor to detect angular velocity information of the vehicle, a GPS sensor to detect location information of the vehicle, and an acceleration sensor to detect acceleration information of the vehicle.

17. The electronic device of claim 16, wherein the programming instructions are further executable by the at least one processor to cause the electronic device to: generate the vector data by using at least one of the location information and the acceleration information and correct the vector data by using an earth magnetic field sensor.

18. The electronic device of claim 15, wherein the communication unit receives sensor information from a sensor installed in the vehicle or another vehicle adjacent to the vehicle and the programming instructions are further executable by the at least one processor to cause the electronic device to: use the received sensor information as measurement information of the vehicle or detects dangerous situation information based on the sensor information and inform of the detected dangerous situation information.

19. The electronic device of claim 18, wherein the programming instructions are further executable by the at least one processor to cause the electronic device to: compare the dangerous situation information with a preset degree of danger and generate a notification for the dangerous situation information according to a corresponding degree of danger based on a result of the comparison.

20. The electronic device of claim 19, wherein the notification includes at least one of sound information, voice information, and display information associated with the dangerous situation information according to the degree of danger, the electronic device further comprising an output unit for outputting at least one of the sound information, voice information, and display information.

21. An electronic device, comprising:

a communication unit; at least one processor; and a memory storing programming instructions executable by the at least one processor to cause the electronic device to:

receive, by the communication unit of the electronic device, vector data transmitted from a portable device disposed within a vehicle, identify at least two accident types matching the received vector data, from among a plurality of pre-stored accident types by comparison of the received vector data to a plurality of prestored vector data, each associated with at least one of the plurality of prestored accident types;

select a final accident type from among the identified at least two accident type by detecting a match between one of the identified at least two accident types with the detected location of the vehicle and retrieve pre-stored dangerous situation information including identification of at least one road hazard pre-associated with the selected final accident type; and transmit the retrieved pre-stored dangerous situation information to the portable device for notification of the at least one road hazard.

22. The electronic device of claim 21, wherein selecting the final accident type further includes detecting a match between one of the identified at least two accident types with s at least one of road information, road history information, road condition information, weather information, and time information corresponding to the matched detected location.

23. The electronic device of claim 21, wherein the programming instructions are further executable by the at least one processor to cause the electronic device to: generate vehicle vector data based on location information of the vehicle, calculate sensor error information by using the vehicle vector data, and filter the accident type based on the calculated sensor error information.

24. The electronic device of claim 21, wherein the programming instructions are further executable by the at least one processor to cause the electronic device to: detect a vector pattern based on vector data of a plurality of vehicles and filters the accident type based on the vector pattern.

25. The electronic device of claim 21, wherein the programming instructions are further executable by the at least one processor to cause the electronic device to: calculate a distance from the vehicle based on location information of the dangerous situation information, and inform different dangerous situation information according to the distance to a portable device within the vehicle through the communication unit.

* * * * *